US007034448B2

(12) United States Patent
Lee et al.

(10) Patent No.: US 7,034,448 B2
(45) **Date of Patent: *Apr. 25, 2006**

(54) FIELD EMISSION DISPLAY

(75) Inventors: Chun-Gyoo Lee, Gwacheon (KR); Sang-Jo Lee, Kyungki-do (KR); Yong-Soo Choi, Seoul (KR); Sang-Hyuck Ahn, Seoul (KR); Byong-Gon Lee, Suwon (KR); Ho-Su Han, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 183 days.

This patent is subject to a terminal disclaimer.

(21) Appl. No.: 10/413,445

(22) Filed: Apr. 14, 2003

(65) Prior Publication Data

US 2003/0230968 A1 Dec. 18, 2003

(30) Foreign Application Priority Data

| | | |
|---|---|---|
| Apr. 12, 2002 | (KR) | 10-2002-0020004 |
| Apr. 22, 2002 | (KR) | 10-2002-0021964 |
| Dec. 11, 2002 | (KR) | 10-2002-0078780 |
| Dec. 12, 2002 | (KR) | 10-2002-0079225 |

(51) Int. Cl.
*H01J 19/24* (2006.01)

(52) U.S. Cl. ..... 313/495; 313/346 R; 313/309

(58) Field of Classification Search ..... 313/495–497, 313/309, 310, 346 R, 336

See application file for complete search history.

(56) References Cited

U.S. PATENT DOCUMENTS

| | | | | |
|---|---|---|---|---|
| 3,789,471 | A | 2/1974 | Spindt et al. | |
| 5,726,530 | A * | 3/1998 | Peng | 313/495 |
| 6,062,931 | A | 5/2000 | Chuang et al. | |
| 6,097,138 | A | 8/2000 | Nakamoto | |
| 6,239,547 | B1 * | 5/2001 | Uemura et al. | 313/495 |
| 6,246,168 | B1 * | 6/2001 | Kishi et al. | 313/495 |
| 6,420,726 | B1 | 7/2002 | Choi et al. | |
| 6,545,396 | B1 * | 4/2003 | Ohki et al. | 313/309 |
| 6,577,057 | B1 | 6/2003 | Yamamoto et al. | |

(Continued)

FOREIGN PATENT DOCUMENTS

JP 2000-268704 9/2000

OTHER PUBLICATIONS

Patent Abstract of Japan, Publication No. 2000-268704, Published on Sep. 29, 2000, in the name of Futaba Corp.

(Continued)

*Primary Examiner*—Nimeshkumar D. Patel
*Assistant Examiner*—German Colón
(74) *Attorney, Agent, or Firm*—Christie, Parker & Hale, LLP

(57) ABSTRACT

A field emission display includes a first substrate and a second substrate opposing one another with a predetermined gap therebetween. At least one gate electrode is formed on the first substrate. An insulation layer formed over the first substrate covering the gate electrode. Cathode electrodes are formed on the insulation layer and including field enhancing sections that expose the insulation layer corresponding to pixel regions. Electron emission sources formed over the cathode electrodes adjacent at least one side of the field enhancing sections. An illumination assembly is formed on the second substrate and realizes the display of images by electrons emitted from the electron emission sources.

31 Claims, 16 Drawing Sheets

U.S. PATENT DOCUMENTS

| | | | | |
|---|---|---|---|---|
| 6,621,232 | B1 * | 9/2003 | Jo et al. | 315/169.3 |
| 6,717,340 | B1 * | 4/2004 | Nishimura | 313/310 |
| 6,741,019 | B1 | 5/2004 | Filas et al. | |
| 2001/0006232 | A1 * | 7/2001 | Choi et al. | 257/10 |
| 2004/0012327 | A1 * | 1/2004 | Shiratori et al. | 313/497 |

OTHER PUBLICATIONS

Lee, et al., "32 Under-Gate CNT Cathode for Large TV Applications", Technical Digest vol. 1/2, 15th International Vacuum Microelectronics Conference & 48th International Field Emission Symposium, Jul. 7-11, 2002, Lyon, France.

* cited by examiner

FIELD EMISSION DISPLAY

CROSS-REFERENCE TO RELATED APPLICATIONS

This application claims priority to and the benefit of Korean Application Nos. 2002-20004, 2002-21964, 2002-78780, and 2002-79225, respectively filed on Apr. 12, 2002, Apr. 22, 2002, Dec. 11, 2002, and Dec. 12, 2002 in the Korean Industrial Property Office, the entire disclosures of which are incorporated herein by reference.

BACKGROUND OF THE INVENTION (a) Field of the Invention

The present invention relates to field emission displays (FEDs). More particularly, the present invention relates to FEDs that include electron emission sources made of carbon-based material.

(b) Description of the Related Art

In modern FEDs, a thick-layer process such as screen printing is used to form electron emission sources (i.e., emitters) in a flat configuration utilizing a carbon-based material that emits electrons at low voltage driving conditions (e.g., 10–100V).

Carbon-based materials suitable for forming the emitters include graphite, diamond, diamond-like carbon, and carbon nanotubes (CNTs). Among these, carbon nanotubes appear to be very promising for use as emitters because of their extremely minute tips with a radius of curvature of approximately tens to several tens of nanometers, and because carbon nanotubes are able to emit electrons in low electric field conditions of about 1–10V/μm.

U.S. Pat. Nos. 6,062,931 and 6,097,138 disclose cold cathode field emission displays that are related to this area of FEDs using CNT technology.

In the case where the FEDs employ a triode structure having cathode electrodes, an anode electrode, and gate electrodes, cathode electrodes, an insulation layer, and gate electrodes are formed on a rear substrate in this order, holes are formed in the gate electrodes and the insulation layer to expose the cathode electrodes, then emitters are formed on exposed surfaces of the cathode electrodes. Also, an anode electrode and phosphor layers are formed on a front substrate.

However, with such a structure, when providing emitter material on the surfaces of the cathode electrodes exposed through the holes, the emitter material may extend between the cathode electrodes and gate electrodes to form short circuits between these two elements. Further, with the conventional triode structure, when the electrons emitted from the emitters are formed into electron beams and travel toward the phosphor layers, a diverging force of the electron beams is increased by influence of a positive voltage applied to the gate electrodes such that the electron beams disperse.

To remedy these problems, with reference to FIG. 26, there is disclosed an FED in which gate electrodes 3 are first formed on rear substrate 1, and after insulation layer 5 is formed over gate electrodes 3, cathode electrodes 7 and emitters 9 are formed on insulation layer 5. The formation of a short circuit between cathode electrodes 7 and gate electrodes 3 by emitter material is avoided with this configuration. Also, since emitters 9 are formed lastly (i.e., on an outermost layer of rear substrate 1), emitters 9 are easily formed on cathode electrodes 7.

In the FED of FIG. 26, emitters 9 are typically formed along one long edge of cathode electrodes 7, and the electric field induced from gate electrodes 3 surround emitters 9 to realize field emission. However, since cathode electrodes 7 are generally made having a significant width to ensure good conductivity, significant influence of the electric fields causing field emission is limited only to the edges of emitters 9.

As a result, compared to the FED using the conventional triode structure, the electric field intensity around emitters 9 is significantly lower, and the drive voltage and power consumption required for electron emission is high since the area of field emission is limited. Also, because of this small area of field emission, the amount of electrons that are emitted is small such that there are limitations in increasing screen brightness.

Further, in the FED of FIG. 26, if a distance between cathode electrodes 7 exceeds a predetermined amount (for example, more than one-third of a gate electrode pitch), a neighboring effect, in which variations in the electric field intensities in the vicinity of emitters 9 occur by a data voltage applied to gate electrodes 3 and by a data voltage of adjacent gate electrodes 3.

With respect to a specific emitter 9 forming one pixel, the neighboring effect refers to the phenomenon in which if a data voltage is applied to gate electrode 3 of an adjacent pixel, the electric field around emitter 9 of this pixel is significantly strengthened such that emission current is increased, and if a data voltage is not applied to gate electrode 3 of an adjacent pixel, the electric field around emitter 9 of this pixel is weakened such that electron emission is decreased.

Therefore, if a data voltage is applied to a specific gate electrode 3, electron emission occurs not only from emitter 9 corresponding to this gate electrode 3 but also from adjacent emitters 9 such that phosphor layer 11 surrounding the intended phosphor layer 11 are illuminated, thereby reducing color purity. In addition, although brightness is maintained in the case where a white color is displayed on the screen, if colors are displayed, these areas may become dark such that uneven brightness occurs in the picture.

The above problem may be minimized by reducing the distance between cathode electrodes 7. In one embodiment where the pitch of gate electrodes 3 is 320 μm, the neighboring effect disappears if the distance between cathode electrodes 7 is set at approximately 20 μm.

However, if cathode electrodes 7 are positioned too closely, the data voltage applied to cathode electrodes 7 is cut off by adjacent cathode electrodes 7 such that an increase in the electric field of corresponding emitters 9 is unable to be realized. Therefore, the control of field emission by gate electrodes 3 is not possible, thereby making matrix driving unattainable.

Further, in the FED described above, the electric fields are concentrated on the edges of emitters 9 so that electron emission occurs from only the edges of emitters 9. A characteristic of such edge emission is that the electron beams formed by the emission of the electrons from emitters 9 are unable to travel perpendicularly in a direction toward corresponding phosphor films 11, and instead travel by spreading parabolically in a predetermined arc. Hence, the electron beams emitted from emitters 9 land not only on phosphor layer 11 in the intended pixel, but on phosphor layers 11 of adjacent pixels to illuminate the same. Color purity is reduced as a result and precise images are unable to be realized.

In the conventional FED, picture brightness is proportional to the amount of electrons emitted from emitters 9 and the voltage applied to anode electrode 13. Since the anode current density per unit area of phosphor layers 11 is limited to a predetermined amount when considerations are made to the lifespan of phosphor layers 11, picture brightness is increased when an even higher voltage is applied to anode electrodes 13.

However, with the conventional structure of emitters 9 being opposed to anode electrode 13 with a significant distance therebetween, if an excessive voltage is applied to anode electrode 13 to increase brightness, the electric field between cathode electrodes 7 and anode electrode 13 is increased and it is possible for arcing to occur. This results in damage or heating of emitters 9 such that uniformity in the illumination of the screen is reduced and the lifespan of the emitters deteriorates.

SUMMARY OF THE INVENTION

In accordance with an embodiment of the present invention a field emission display is provided in which electric field emission areas around emitters are increased and a strength of electric fields applied to emitters is increased such that a drive voltage of the display may be decreased and electron emission amounts of the emitters may be increased.

In accordance with another embodiment of the present invention a field emission display is provided in which electric field variations for each pixel by a data voltage applied to gate electrodes of adjacent pixels are prevented such that the neighboring effect phenomenon does not occur.

In accordance with still another embodiment of the present invention a field emission display is provided in which electron beam dispersion is minimized such that electron beams emitted from emitters selectively illuminate phosphor layers of only intended pixels, thereby improving picture quality.

In accordance with yet another embodiment of the present invention a field emission display is provided in which a high voltage is applied to an anode electrode while reducing the possibility of arcing between cathode electrodes and an anode electrode, thereby improving screen brightness.

In a further embodiment of the present invention a field emission display includes a first substrate and a second substrate opposing one another with a predetermined gap therebetween. At least one gate electrode is formed on the first substrate. An insulation layer is formed over a surface of the first substrate covering the gate electrode. Cathode electrodes are formed on the insulation layer and include field enhancing sections that expose the insulation layer corresponding to pixel regions. Electron emission sources are formed on the cathode electrodes adjacent at least one side of the field enhancing sections. An illumination assembly is formed on a surface of the second substrate opposing the first substrate, the illumination assembly realizing the display of images by electrons emitted from the electron emission sources.

The electron emission sources are made of a carbon-based material such as carbon nanotubes, graphite, diamond, diamond-like carbon, and $C_{60}$ (Fullerene), or a mixture of these carbon-based materials.

The field enhancing sections may be quadrilateral, and the electron emission sources are formed adjacent at least one side of the field enhancing sections parallel to the gate electrode.

Further, each of the field enhancing sections formed in the cathode electrodes and that expose the insulation layer corresponding to each of the pixel regions includes a main field enhancing section and an auxiliary field enhancing section. The main field enhancing sections and the auxiliary field enhancing sections are quadrilateral, and the electron emission sources are formed adjacent to a side of the main field enhancing sections that are closest to the auxiliary field enhancing section.

The field emission display further includes counter electrodes positioned in the field enhancing sections and connected to the gate electrode. The counter electrodes are connected to the gate electrode by contacting the gate electrode through via holes formed in the insulation layer. The counter electrodes maintain a predetermined distance from the cathode electrodes within the field enhancing sections.

The electron emission sources may be formed on an upper surface and extending over a side surface of the cathode electrodes. Further, the field emission sources may be formed on the insulation layer, and the cathode electrodes may be formed on the electron emission sources covering a portion of the electron emission sources.

The field emission display further includes counter electrodes positioned between the cathode electrodes and connected to the gate electrode. In this case, the field emission sources are formed on the cathode electrodes between the field enhancing sections and the counter electrodes. Also, a distance between a long edge of the cathode electrodes on which the emitters are positioned and the field enhancing sections is less than a distance between an opposite long edge of the cathode electrodes where the emitters are not located and the field enhancing sections.

The field emission display further includes pushing electrodes formed between the counter electrodes and the cathode electrodes in a direction of the cathode electrodes. The pushing electrodes receive an application of 0V or a negative voltage to provide a repelling force to electron beams emitted from the electron emission sources.

The electron emission sources are formed adjacent at least one side of the field enhancing sections parallel to the cathode electrodes, and the electron emission sources are positioned at a predetermined distance from a long edge of the cathode electrodes. Accordingly, cathode electrode sections surrounding three sides of the field enhancing sections where the electron emission sources are not formed act to provide a pushing force to the electrons emitted from the electron emission sources.

DETAILED DESCRIPTION OF THE PREFERRED EMBODIMENTS

Embodiments of the present invention will now be described in detail with reference to the accompanying drawings. It is to be understood that the structure of the present invention is useful not only for field emission displays, but also for similar flat panel displays, such as vacuum fluorescent displays.

Figure 1:
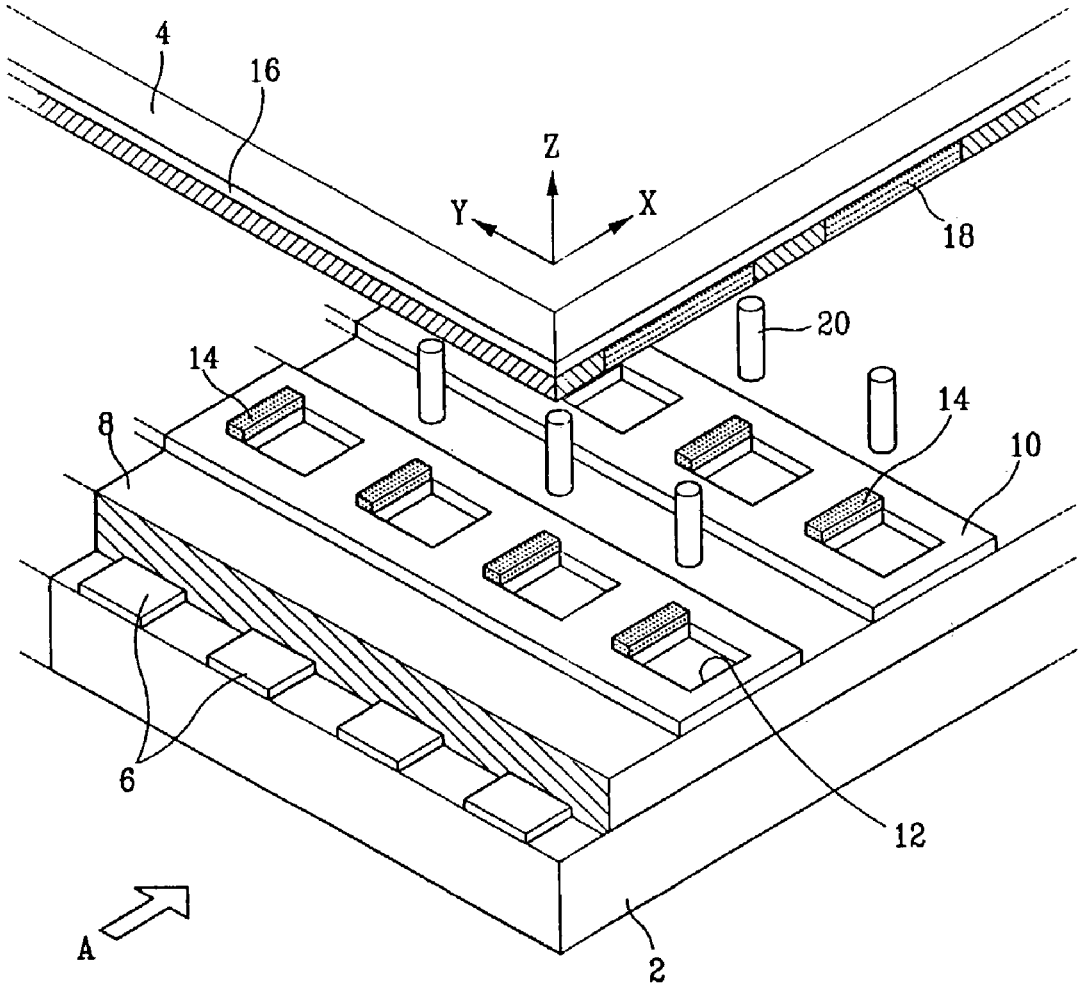
FIG. 1 is a partial exploded perspective view of a field emission display according to a first embodiment of the present invention.
Figure 2:
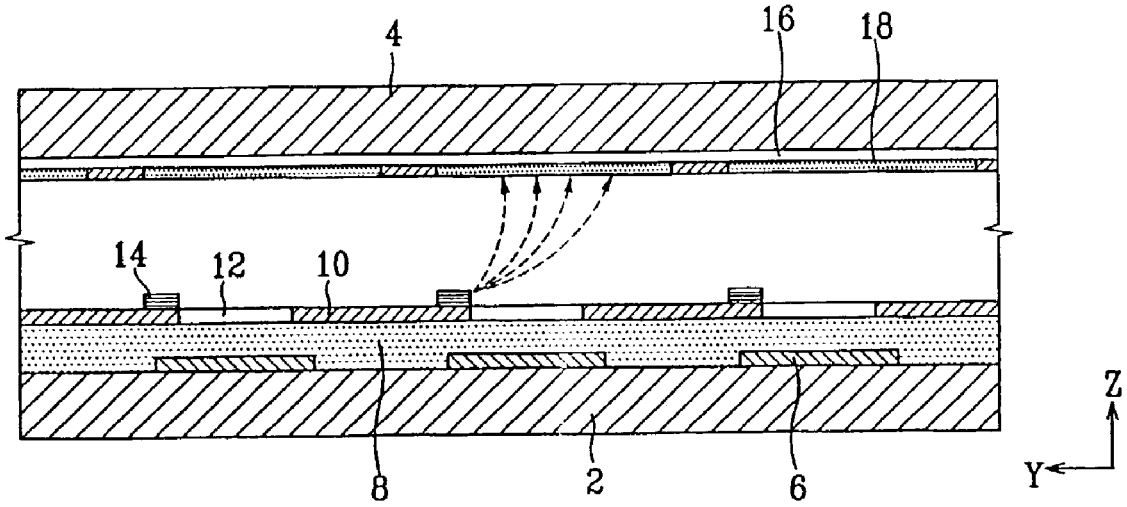
FIG. 2 is a partial sectional view of the field emission display of FIG. 1 as viewed from direction A and shown in an assembled state.

FIG. 1 is a partial exploded perspective view of a field emission display according to a first embodiment of the present invention, and FIG. 2 is a partial sectional view of the field emission display of FIG. 1 as viewed from direction A and shown in an assembled state.

As shown in the drawings, the field emission display (FED) includes first substrate 2 of predetermined dimensions (hereinafter referred to as a rear substrate) and second substrate 4 of predetermined dimensions (hereinafter referred to as a front substrate). Front substrate 4 is provided opposing rear substrate 2 with a predetermined gap therebetween. A structure to enable the emission of electrons by forming an electric field is provided on rear substrate 2 and a structure to enable the realization of predetermined images by the interaction with emitted electrons is provided on front substrate 4.

In more detail, at least one gate electrode 6, especially a plurality of gate electrodes 6 are formed on rear substrate 2 in a stripe pattern along one direction (for example, an axis X direction of the drawings). Further, insulation layer 8 is formed over an entire surface of rear substrate 2 covering gate electrodes 6. Cathode electrodes 10 are formed on insulation layer 8 in a stripe pattern along a direction perpendicular to the direction of the long axes of gate electrodes 6 (for example, an axis Y direction of the drawings).

In the case where pixel regions are defined at locations of intersection between cathode electrodes 10 and gate electrodes 6, field enhancing sections 12 are formed in cathode electrodes 10 corresponding to each pixel region in such a manner that insulation layer 8 is exposed. Electron emission sources made of carbon-based material, that is, emitters 14 are positioned on cathode electrodes 10 adjacent to one edge of field enhancing sections 12.

Field enhancing sections 12 are simply areas where portions of the conductive material of cathode electrodes 10 are removed. This is done such that field enhancing sections 12 are formed fully within cathode electrodes 10 to be surrounded by cathode electrodes 10. In one embodiment field enhancing sections 12 are quadrilateral. Also, emitters 14 are positioned on cathode electrodes 10 adjacent to one side of field enhancing sections 12 parallel to gate electrodes 6. That is, in one embodiment emitters 14 are substantially rectangular in shape with one long side parallel to gate electrodes 6.

Emitters 14 may be made of a carbon-based material such as carbon nanotubes, graphite, diamond, diamond-like carbon, and $C_{60}$ (Fullerene), or are made of a mixture of these carbon-based materials. Carbon nanotubes are used in accordance with an embodiment of the present invention.

Formed on a surface of front substrate 4 opposing rear substrate 2 are anode electrode 16, to which a high voltage of approximately 1–5 kV is applied, and phosphor layers 18 made of red (R), green (G), and blue (B) phosphors.

Anode electrode 16 may be a transparent electrode made of a material such as indium tin oxide (ITO), in which case anode electrode 16 is formed on the surface of front substrate 4 opposing rear substrate 2, and phosphor layers 18 are formed on anode electrode 16. It is also possible for anode electrode 16 to be made of a metal thin film such as an aluminum thin film, in which case phosphor layers 18 are formed on the surface of front substrate 4 opposing rear substrate 2, and anode electrode 16 is formed on phosphor layers 18.

Front substrate 4 and rear substrate 2 structured as in the above are provided opposing one another with spacers 20 interposed therebetween to maintain the predetermined gap between front substrate 4 and rear substrate 2. A sealant (not shown) is provided around edges and surfaces of front substrate 4 and rear substrate 2 opposing one another. A space (i.e., the gap) between front substrate 4 and rear substrate 2 is evacuated. Then these elements are fully sealed to thereby complete the FED.

With the above structure, if a predetermined DC or AC voltage is applied between cathode electrodes 10 and gate electrodes 6, and a high voltage of a few hundred to a few thousand volts are applied to anode electrode 16, electric fields of gate electrodes 6 operate in the vicinity of emitters 14 through areas of insulation layer 8 exposed by field enhancing sections 12, thereby forming electric fields in the area of emitters 14 by a potential difference of cathode electrodes 10 and gate electrodes 6. Electrons are emitted from edges of emitters 14 adjacent to field enhancing sections 12 by these electric fields. The emitted electrons form electron beams to land on phosphor layers 18 of the corresponding pixels to illuminate phosphor layers 18 and thereby realize the display of predetermined images.

All sides of emitters 14 except for the long edges of the same adjacent to field enhancing sections 12 are surrounded by cathode electrodes 10. Accordingly, when a predetermined voltage is applied to cathode electrode 10 on which one of the emitters 14 is positioned, this cathode voltage acts to block electric fields from entering into the region of this emitter 14 by the voltage applied to cathode electrodes 10 of adjacent pixels or to gate electrodes 6 of adjacent pixels.

Therefore, the neighboring effect phenomenon is reduced, in which the strength of electric fields in the vicinity of a specific emitter 14 is varied by the voltage applied to gate electrodes 6 of adjacent pixels. This, in turn, prevents the illumination of unintended pixels to thereby improve color purity and brightness uniformity.

Figure 3:
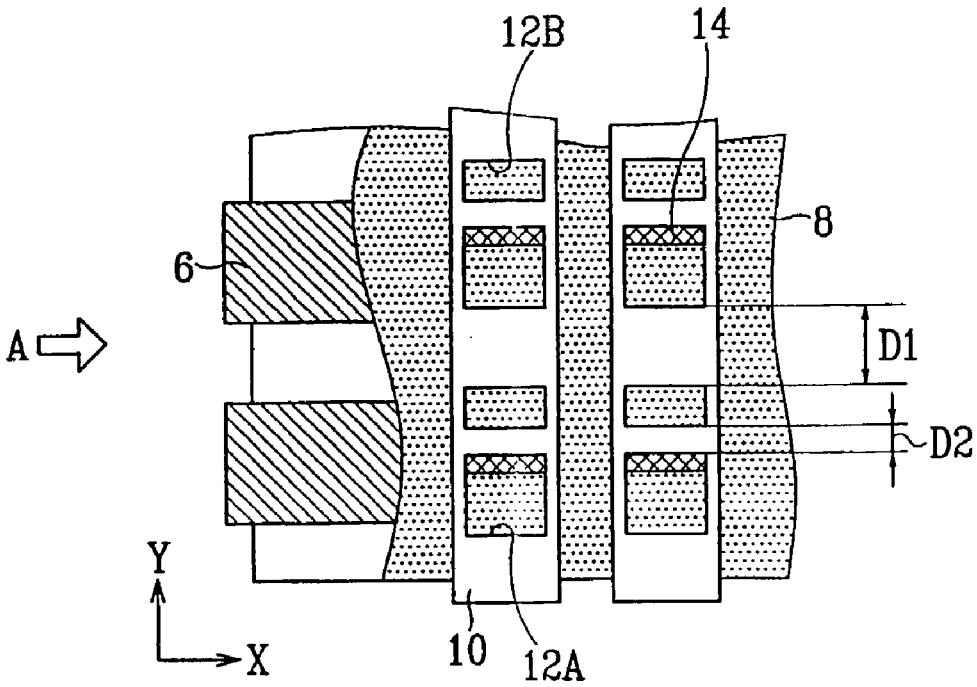
FIG. 3 is a partial plan view of a rear substrate of a field emission display according to a second embodiment of the present invention.
Figure 4:
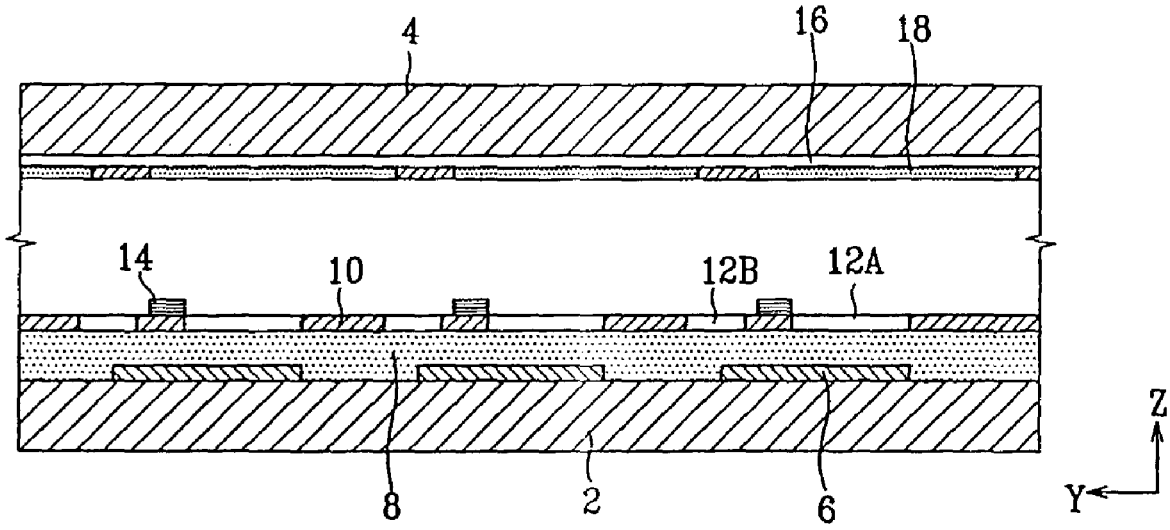
FIG. 4 is a partial sectional view of the field emission display of FIG. 3 as viewed from direction A and shown in an assembled state.

FIG. 3 is a partial plan view of a rear substrate of a field emission display according to a second embodiment of the present invention, and FIG. 4 is a partial sectional view of the field emission display of FIG. 3 as viewed from direction A and shown in an assembled state.

As shown in the drawings, main field enhancing section 12A and auxiliary field enhancing section 12B are formed in pairs in cathode electrodes 10 at areas corresponding to each pixel region and along cathode electrodes 10 (in an axis Y direction of the drawings). Emitters 14 are positioned on cathode electrodes 10 adjacent to one edge of main field enhancing sections 12A. That is, for each pair of main field enhancing sections 12A and auxiliary field enhancing sections 12B, an emitter 14 is positioned adjacent to one of the edges of the main field enhancing section 12A that is closest its paired auxiliary field enhancing section 12B.

Main field enhancing sections 12A and auxiliary field enhancing sections 12B are formed by removing portions of the conductive material of cathode electrodes 10 to expose insulation layer 8. Accordingly, with the application of predetermined drive voltages to each of cathode electrodes 10 and gate electrodes 6, electric fields of gate electrodes 6 are more easily formed in the vicinity of emitters 14 and covering a larger area. Therefore, when compared to the FED of the first embodiment, it is possible to reduce drive voltages of the FED of the second embodiment.

In the second embodiment, auxiliary field enhancing sections 12B may have a distance D1 with main field enhancing sections 12A of an adjacent pixel along the same cathode electrodes 10, and that distance D1 is greater than a distance D2 between each pair of main field enhancing sections 12A and auxiliary field enhancing sections 12B. If this latter condition is satisfied, the smooth driving of the individual pixels is realized, and electric field variations of the pixels by voltages applied to electrodes of adjacent pixels are minimized.

Figure 5:
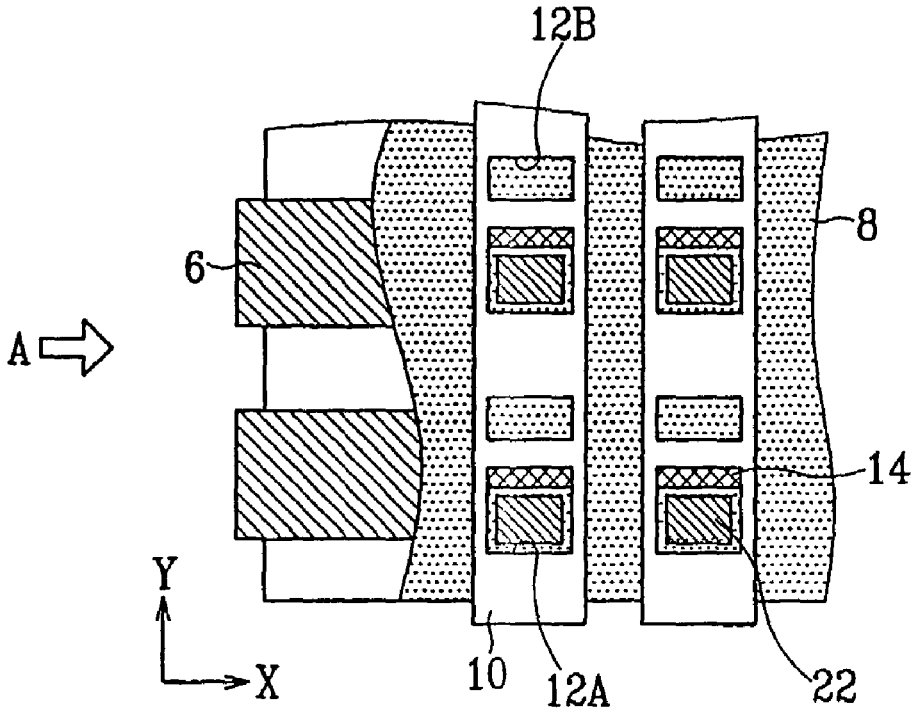
FIG. 5 is a partial plan view of a rear substrate of a field emission display according to a third embodiment of the present invention.
Figure 6:
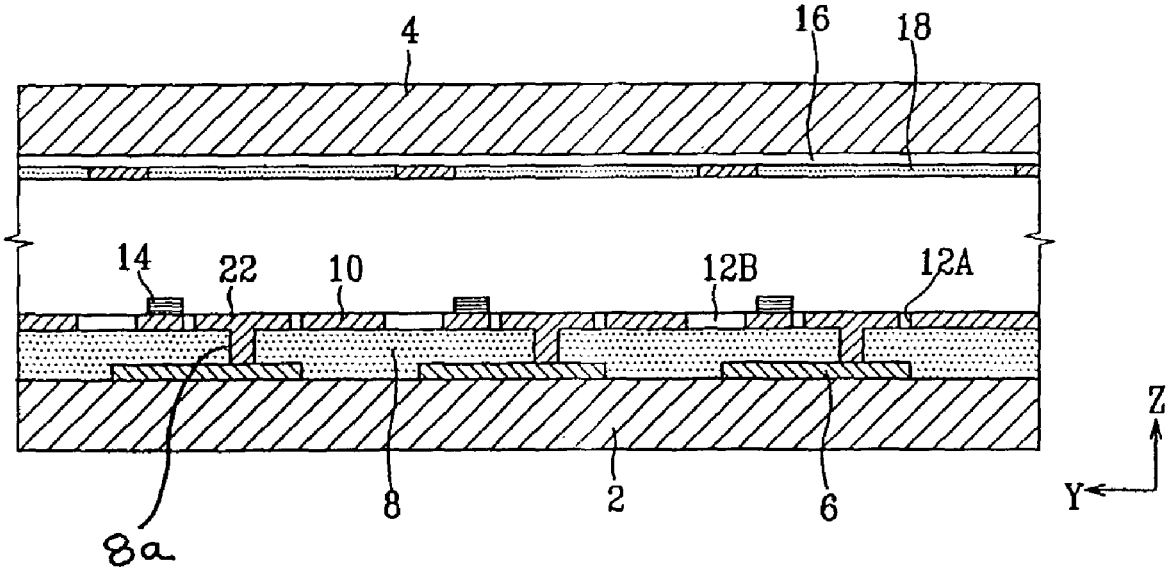
FIG. 6 is a partial sectional view of the field emission display of FIG. 5 as viewed from direction A and shown in an assembled state.

FIG. 5 is a partial plan view of a rear substrate of a field emission display according to a third embodiment of the present invention, and FIG. 6 is a partial sectional view of the field emission display of FIG. 5 as viewed from direction A and shown in an assembled state.

Using the basic structure of the second embodiment, the FED further includes counter electrodes 22 formed in main field enhancing sections 12. Counter electrodes 22 are connected to gate electrodes 6. That is, via hole 8*a* is formed in each of the main field enhancing sections 12A passing through insulation layer 8, and one of the counter electrodes 22 is formed in each of the main field enhancing sections 12A covering and passing through the corresponding via hole 8*a* to contact the corresponding gate electrode 6.

When a predetermined drive voltage is applied to gate electrodes 6 to form electric fields between gate electrodes 6 and emitters 14 for electron emission, counter electrodes 22 act to attract the voltage of gate electrodes 6 in the periphery of emitters 14 such that stronger electric fields are applied to emitters 14. As a result, electrons are more effectively emitted from emitters 14.

Counter electrodes 22 may be formed to smaller dimensions than main field enhancing sections 12 to maintain a predetermined distance from cathode electrodes 10, thereby preventing the formation of short circuits between cathode electrodes 10 and emitters 14 during manufacture.

The third embodiment further including counter electrodes 22 may also be realized by using the basic structure of the first embodiment and adding counter electrodes 22 in field enhancing sections 12.

Figure 7:
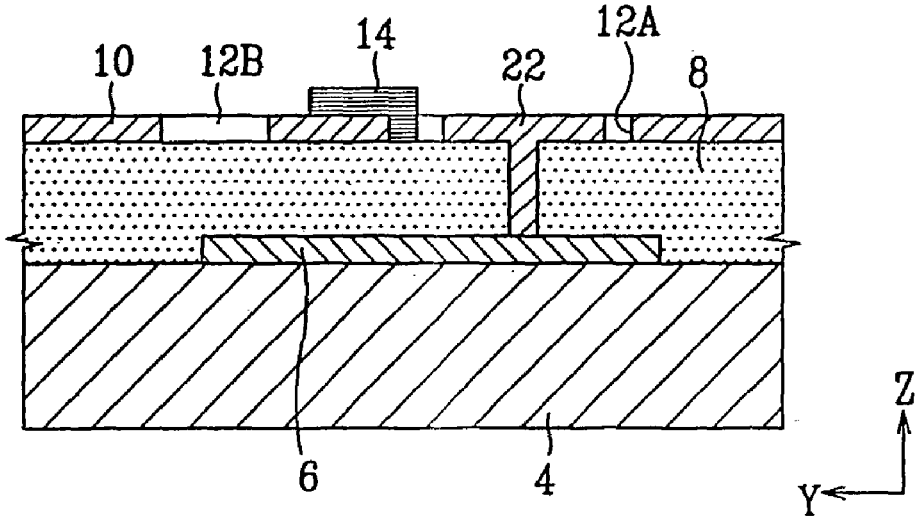
FIG. 7 is a partial sectional view of a field emission display showing a modified example of an emitter.

In the first, second, and third embodiments, emitters 14 are formed only on an upper surface of cathode electrodes 10. However, it is possible to form emitters 14 on the upper surface of cathode electrodes 10 and extending down an adjacent side wall of cathode electrodes 10 leading into field enhancing sections 12 of the first embodiment or main field enhancing sections 12A of the second and third embodiments. Such a structure is shown in FIG. 7, which uses the basic structure of the third embodiment and includes emitters 14 that are formed on the upper surface of cathode electrodes 10 and extend down an adjacent side wall of cathode electrodes 10 leading into main field enhancing sections 12A.

Figure 8:
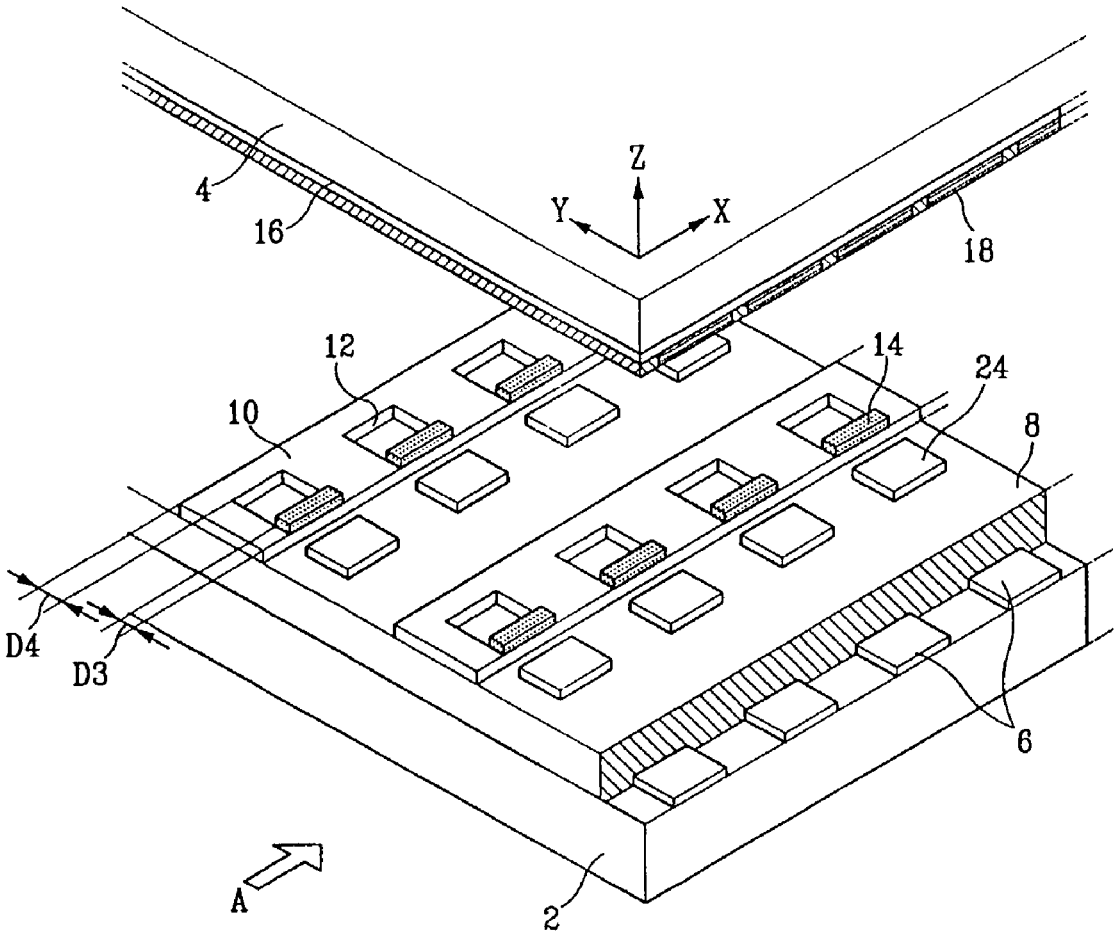
FIG. 8 is a partial exploded perspective view of a field emission display according to a fourth embodiment of the present invention.
Figure 9:
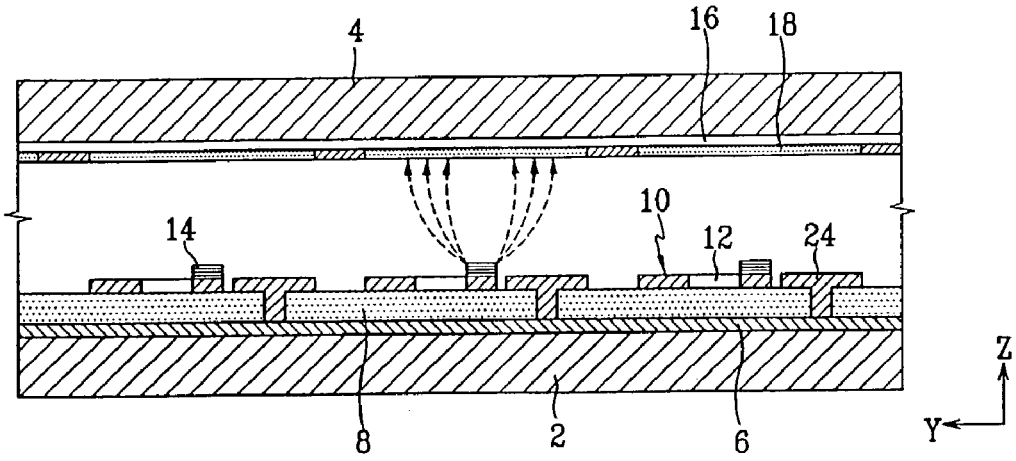
FIG. 9 is a partial sectional view of the field emission display of FIG. 8 as viewed from direction A and shown in an assembled state.

FIG. 8 is a partial exploded perspective view of a field emission display according to a fourth embodiment of the present invention, and FIG. 9 is a partial sectional view of the field emission display of FIG. 8 as viewed from direction A and shown in an assembled state.

As shown in the drawings, field enhancing section 12 that exposes insulation layer 8 is formed in cathode electrodes 10 in each pixel region, and counter electrodes 24 are formed between cathode electrodes 10 and connected to gate electrodes 6. Emitters 14 are formed along one long edge of cathode electrodes 10 that is adjacent to counter electrodes 24. With this structure, each of the emitters 14 is formed between one of the field enhancing sections 12 and one of the counter electrodes 24.

Accordingly, with the application of a predetermined drive voltage to gate electrodes 6, electric fields of gate electrodes 6 are concentrated along one edge of emitters 14 through areas of insulation layer 8 exposed by field enhancing sections 12, and at the same time, along another edge of emitters 14 by counter electrodes 24. Electric field emission regions formed in the vicinity of emitters 14 are therefore enlarged, and electrons are emitted from not one but two edges of emitters 14 to thereby increase electron emission amounts.

In one embodiment a distance D3 between a long edge of cathode electrodes 10 on which emitters 14 are mounted and field enhancing sections 12 is less than a distance D4 between an opposite long edge of cathode electrodes 10 where emitters 14 are not located and field enhancing sections 12.

Such a configuration is used because the smaller the distance D3, the greater the influence of the electric fields on emitters 14 through field enhancing sections 12 to thereby increase the strength of the electric fields applied to emitters 14. Further, since a conductivity of cathode electrodes 10 may be reduced by field enhancing sections 12, the conductivity of cathode 10 is ensured by making the distance D4 large.

Figure 10:
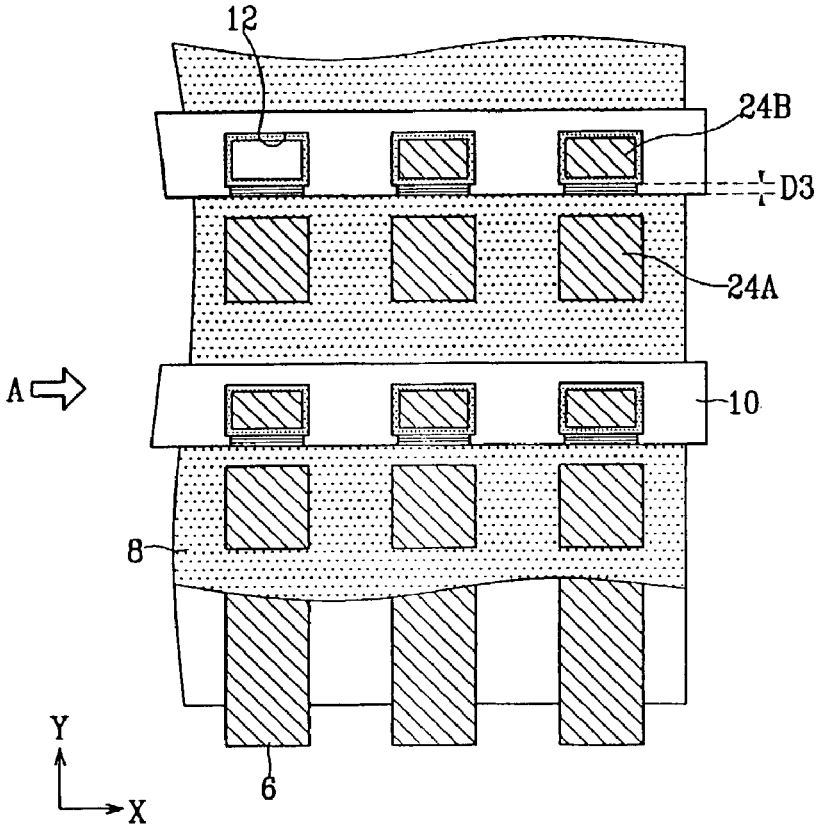
FIG. 10 is a partial plan view of a rear substrate of a field emission display according to a fifth embodiment of the present invention.
Figure 11:
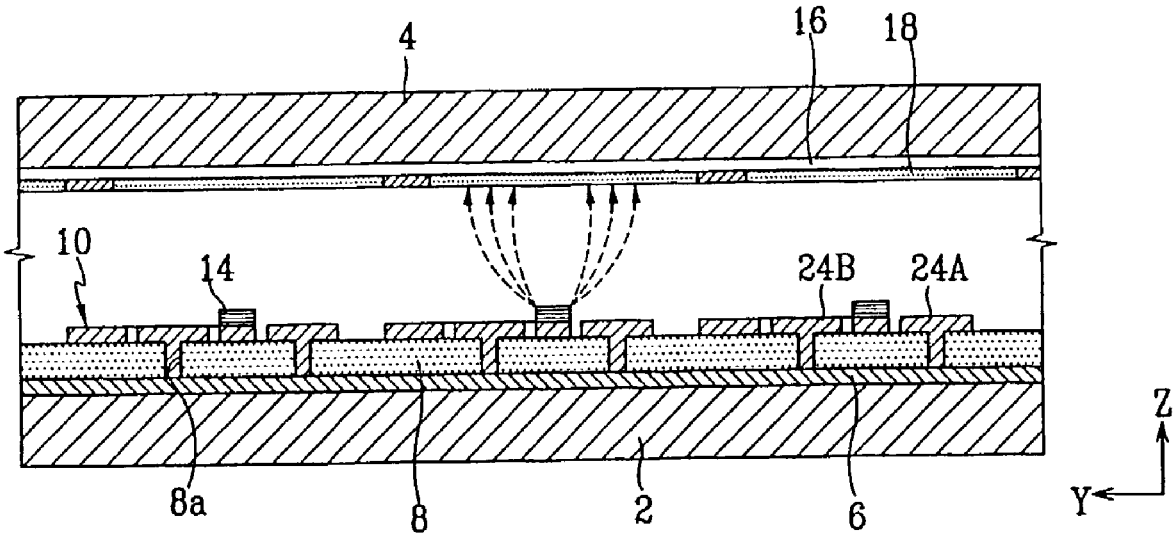
FIG. 11 is a partial sectional view of the field emission display of FIG. 10 as viewed from direction A and shown in an assembled state.

FIG. 10 is a partial plan view of a rear substrate of a field emission display according to a fifth embodiment of the present invention, and FIG. 11 is a partial sectional view of the field emission display of FIG. 10 as viewed from direction A and shown in an assembled state.

The fifth embodiment uses the basic structure of the fourth embodiment and adds an additional element. In particular, in the fifth embodiment, the counter electrodes of the fourth embodiment positioned between cathode electrodes 10 are referred to as main counter electrodes 24A, and auxiliary counter electrodes 24B are formed in field enhancing sections 12. Auxiliary counter electrodes 24B are connected to gate electrodes 6.

As with main counter electrodes 24A, auxiliary counter electrodes 24B pass through via holes 8*a* formed in insulation layer 8 to contact gate electrodes 6. Preferably, auxiliary counter electrodes 24B are formed to a smaller size than field enhancing sections 12 to thereby maintain a predetermined distance from cathode electrodes 10. This prevents the formation of short circuits between cathode electrodes 10 and emitters 14 during manufacture.

The fifth embodiment therefore introduces a structure in which one main counter electrode 24A and one auxiliary counter electrode 24B are formed on opposite sides of each emitter 14. Accordingly, when a predetermined drive voltage is applied to gate electrodes 6, the electric fields of gate electrodes 6 are simultaneously concentrated along opposite edges of emitters 14 through main counter electrodes 24A and auxiliary counter electrodes 24B. This increases the regions of electric field emission in the peripheries of emitters 14, and increases the intensity of the electric fields applied to emitters 14.

The present invention may also employ a structure in which the basic structures of the above embodiments are used, and part of emitters 14 are formed under cathode electrodes 10 such that an opposing area of emitters 14 with respect to anode electrode 16 is reduced. Such a structural change allows for the application of a higher voltage to anode electrode 16 and minimizes the possibility of damage to emitters 14 as a result of arcing.

Figure 12:
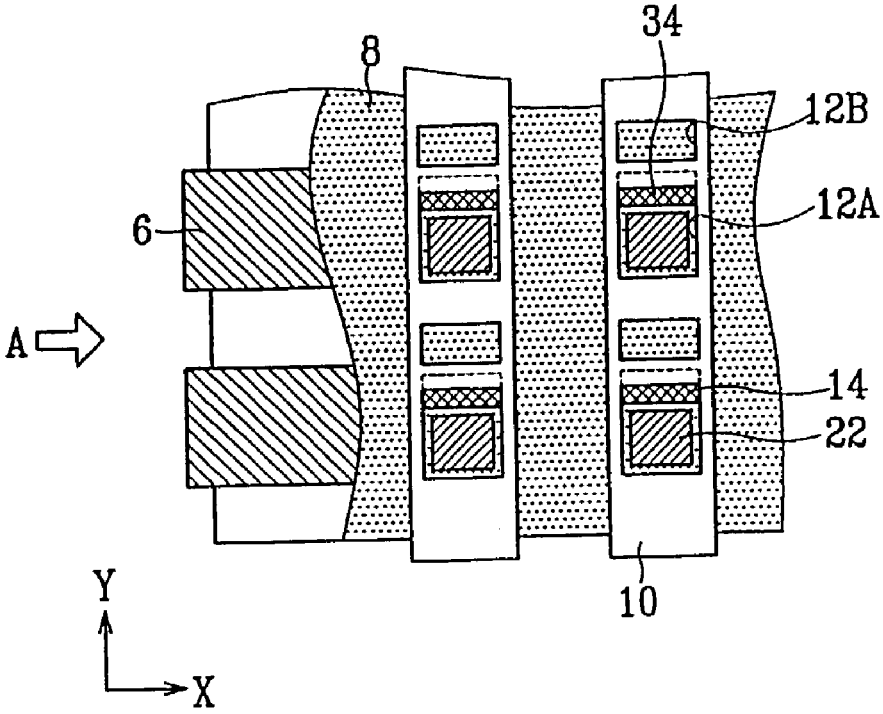
FIG. 12 is a partial plan view of a rear substrate of a field emission display according to a sixth embodiment of the present invention.
Figure 13:
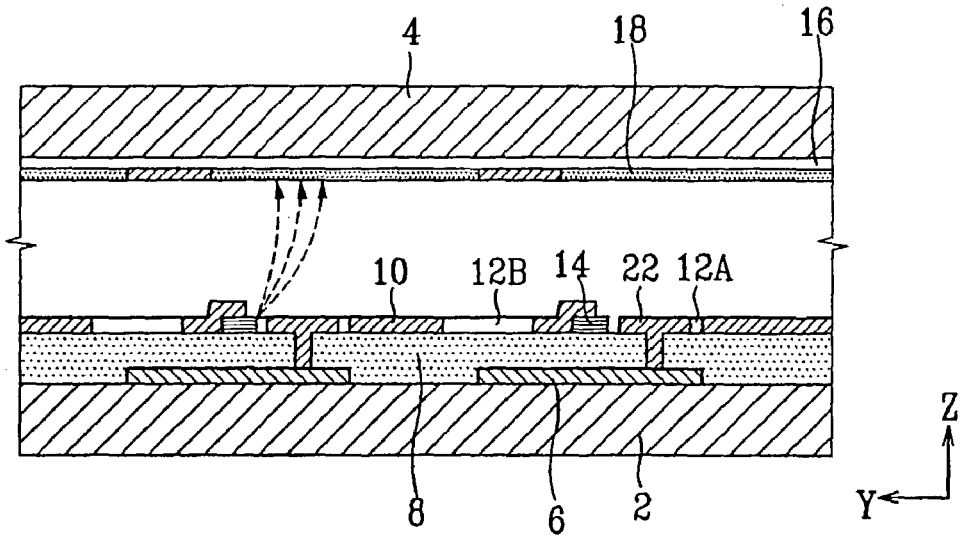
FIG. 13 is a partial sectional view of the field emission display of FIG. 12 as viewed from direction A and shown in an assembled state.

FIG. 12 is a partial plan view of a rear substrate of a field emission display according to a sixth embodiment of the present invention, and FIG. 13 is a partial sectional view of the field emission display of FIG. 12 as viewed from direction A and shown in an assembled state. As an example, the structure of the sixth embodiment is based on the structure of the third embodiment.

As shown in the drawings, rectangular emitters 14 with long sides along an axis X direction are formed in each pixel region on insulation layer 8. Cathode electrodes 10 are formed on insulation layer 8 over all or a portion of each of the emitters 14. In the case where cathode electrodes 10 are formed covering a portion of emitters 14, even if arcing occurs between cathode electrodes 10 and anode electrode 16 when a high voltage is applied to anode electrode 16, an arcing current does not directly influence emitters 14 and instead flows to cathode electrodes 10. Therefore, damage to emitters 14 caused by arcing is prevented and a higher voltage may be applied to anode electrode 16.

In accordance with an embodiment of the present invention where a distance between cathode electrodes 10 and anode electrode 16 is 1 mm, a high voltage of approximately 5 kV may be applied to anode electrode 16. Therefore, assuming a sufficient vacuum state is maintained in the FED, high picture brightness may be realized without damaging emitters 14.

In the above embodiments that include opposing electrodes to form electric fields of a higher strength in the peripheries of the emitters, it is possible for part of the electron beams emitted from the emitters to be attracted by a positive (+) potential applied to the counter electrodes to travel toward the counter electrodes and be diffused. This is particularly problematic in the fourth and fifth embodiment where edges of emitters 14 are parallel to cathode electrodes 10 such that electrons are emitted in a direction substantially perpendicular to cathode electrodes 10.

Therefore, in seventh and eighth embodiments to be described below, structures are employed that focus electron beams, that is, providing a repelling force to the electron beams that are diffused and travel toward counter electrodes.

Figure 14:
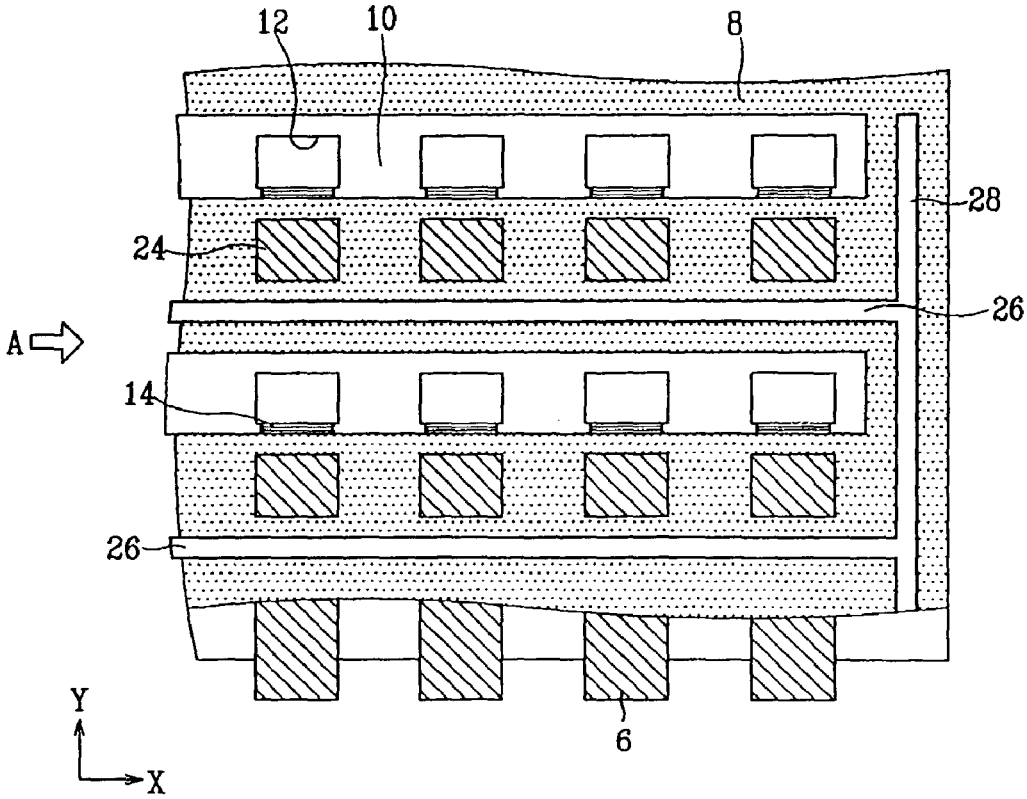
FIG. 14 is a partial plan view of a rear substrate of a field emission display according to a seventh embodiment of the present invention.
Figure 15:
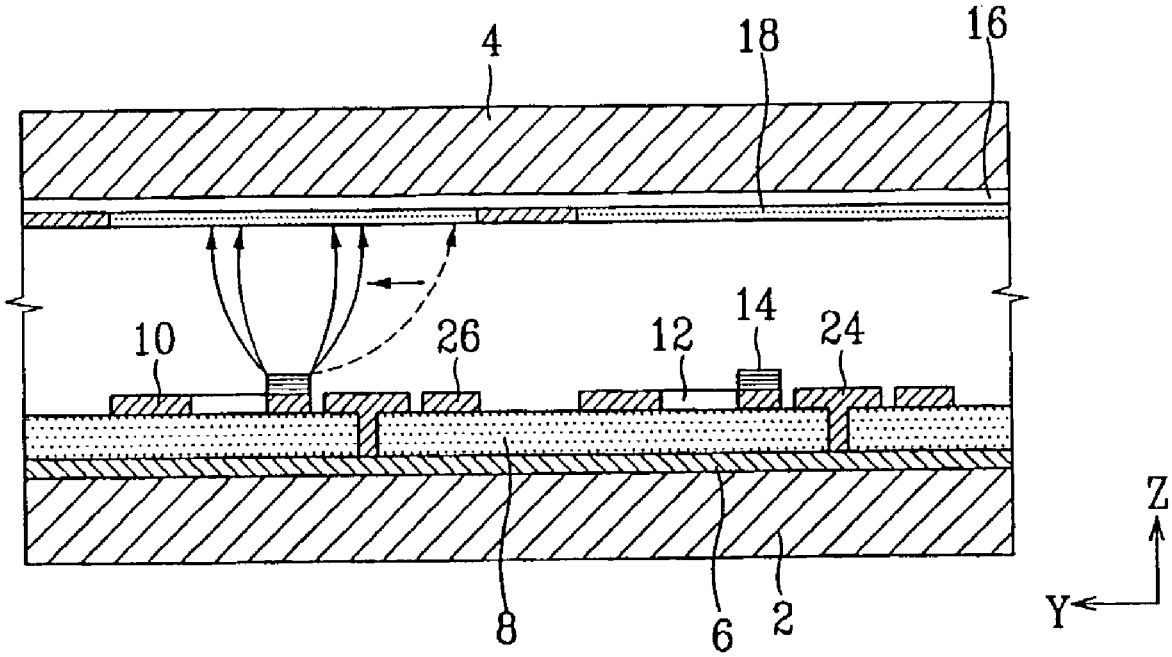
FIG. 15 is a partial sectional view of the field emission display of FIG. 14 as viewed from direction A and shown in an assembled state.

FIG. 14 is a partial plan view of a rear substrate of a field emission display according to a seventh embodiment of the present invention, and FIG. 15 is a partial sectional view of the field emission display of FIG. 14 as viewed from direction A and shown in an assembled state.

As shown in the drawings, the seventh embodiment uses the basic structure of the fourth embodiment and further includes pushing electrodes 26 formed between counter electrodes 24 and cathode electrodes 10 along cathode electrodes 10 (in an axis X direction of the drawings). That is, each row of counter electrodes 24 in the axis X direction corresponds to one cathode electrode 10 and emitters 14 that are formed along a long side of this cathode electrode 10.

Pushing electrodes 26 are formed not between such corresponding counter electrodes 24 and cathode electrodes 10, but instead between the rows of counter electrodes 24 in the axis X direction and cathode electrodes 10 to the opposite side of counter electrodes 24. In one embodiment, one end of pushing electrodes 26 is connected to line 28 to thereby receive an external voltage to focus electron beams.

Accordingly, when electrons are emitted from emitters 14 by a potential difference between cathode electrodes 10 and gate electrodes 6, if 0V or a negative (−) voltage is applied to pushing electrodes 26, a (−) potential of pushing electrodes 26 provides a repelling force to electron beams that are diffused and travel toward counter electrodes 24 to exert a pushing force on these electron beams. Therefore, the electron beams are focused toward phosphor layers 18 of intended pixels.

Figure 16:
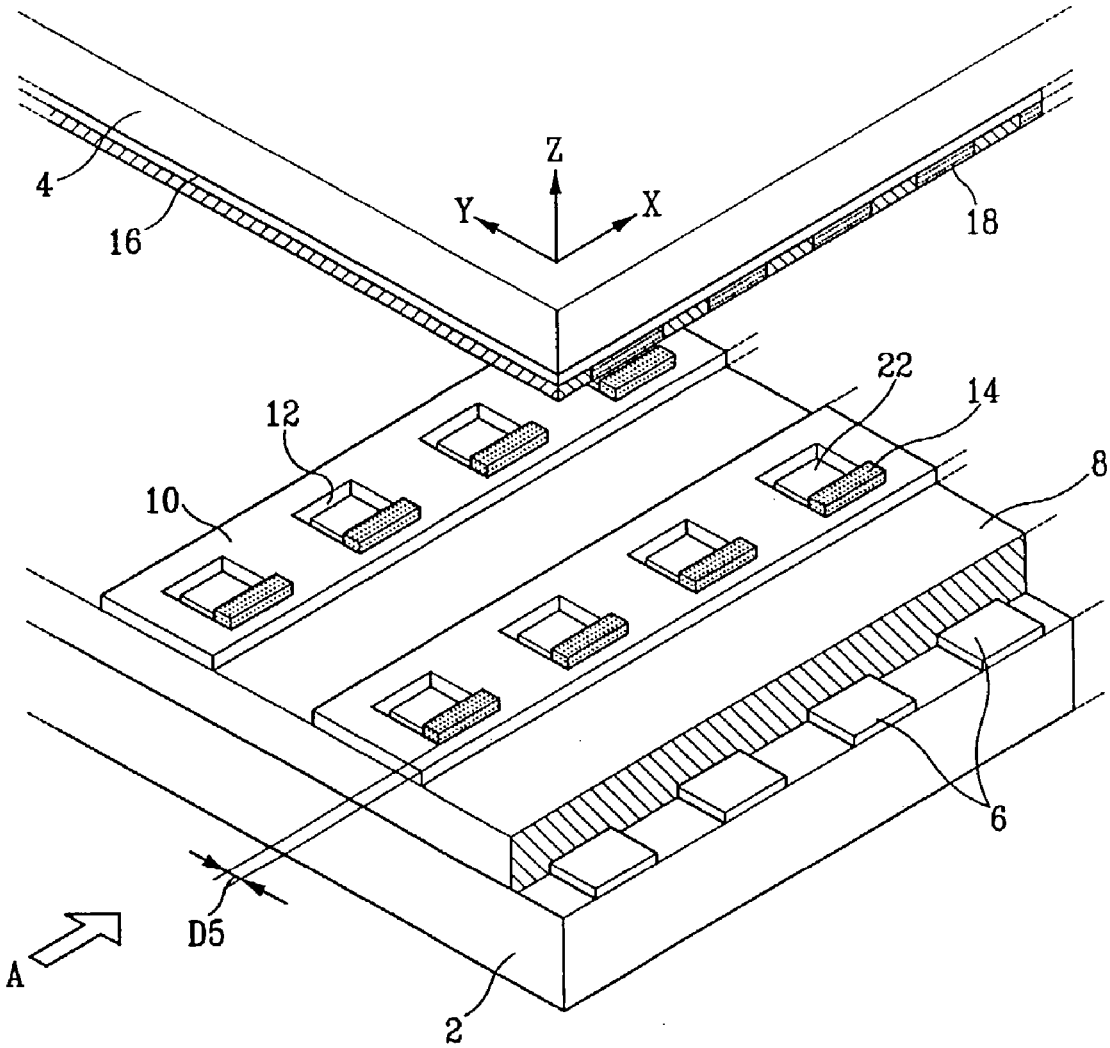
FIG. 16 is a partial exploded perspective view of a field emission display according to an eighth embodiment of the present invention.
Figure 17:
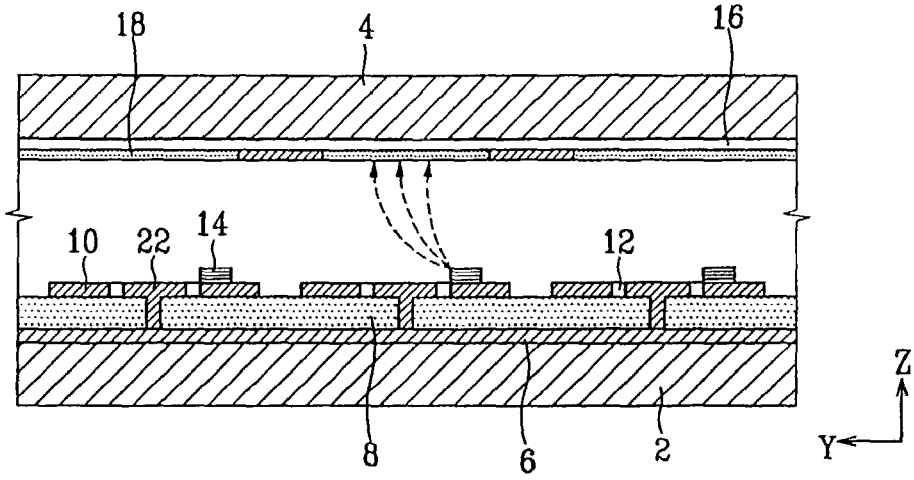
FIG. 17 is a partial sectional view of the field emission display of FIG. 16 as viewed from direction A and shown in an assembled state.

FIG. 16 is a partial exploded perspective view of a field emission display according to an eighth embodiment of the present invention, and FIG. 17 is a partial sectional view of the field emission display of FIG. 16 as viewed from direction A and shown in an assembled state. In the eighth embodiment, rather than mounting additional pushing electrodes, cathode electrodes themselves are made to act as pushing electrodes.

With reference to the drawings, field enhancing sections 12 are formed in cathode electrodes 10 at areas corresponding to each pixel region. Emitters 14 are formed on cathode electrodes 10 on areas of the same adjacent to one of the sides of field enhancing sections 12 formed along cathode electrodes 10 (in an axis X direction of the drawings). Emitters 14 are positioned such that a distance D5 is formed between emitters 14 and a long edge of cathode electrodes 10 closest to emitters 14. Further, counter electrodes 22 are positioned in field enhancing sections 12 in contact with gate electrodes 6.

With this structure, areas of cathode electrodes 10 surrounding all sides of field enhancing sections 12 except the side adjacent to which emitters 14 are formed act to provide a pushing force to minimize the diffusion of electron beams emitted from emitters 14. Such a focusing function of cathode electrodes 10 may be effectively realized by applying a (−) scan voltage to cathode electrodes 10 and a (+) data voltage to gate electrodes 6.

Figure 18:
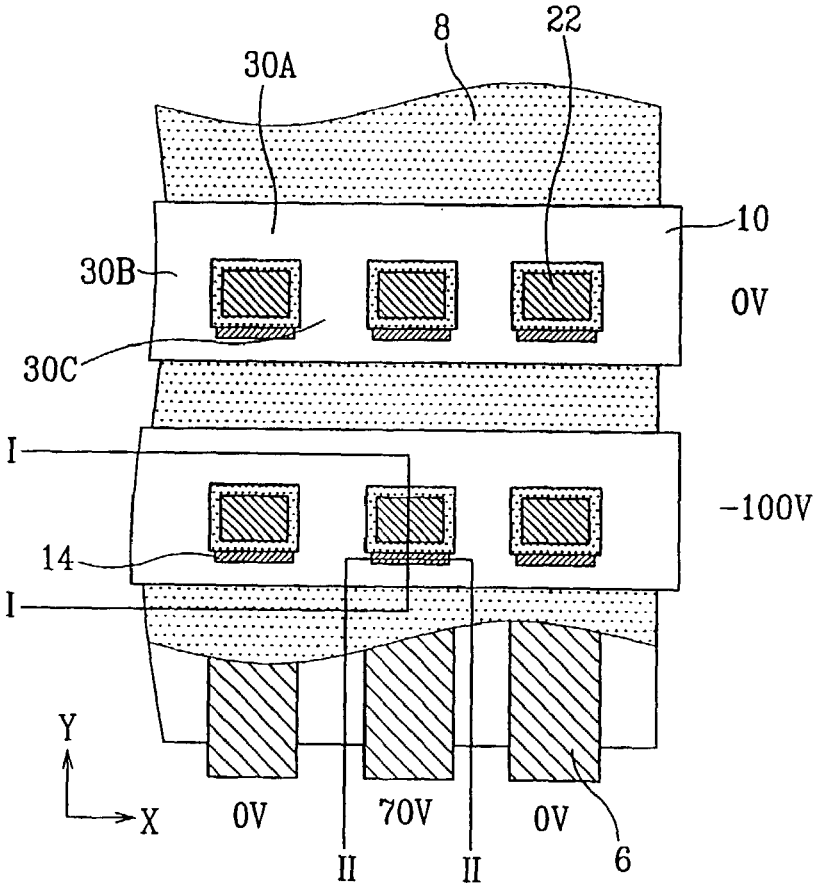
FIG. 18 is a partial plan view of a rear substrate of FIG. 16.
Figure 19:
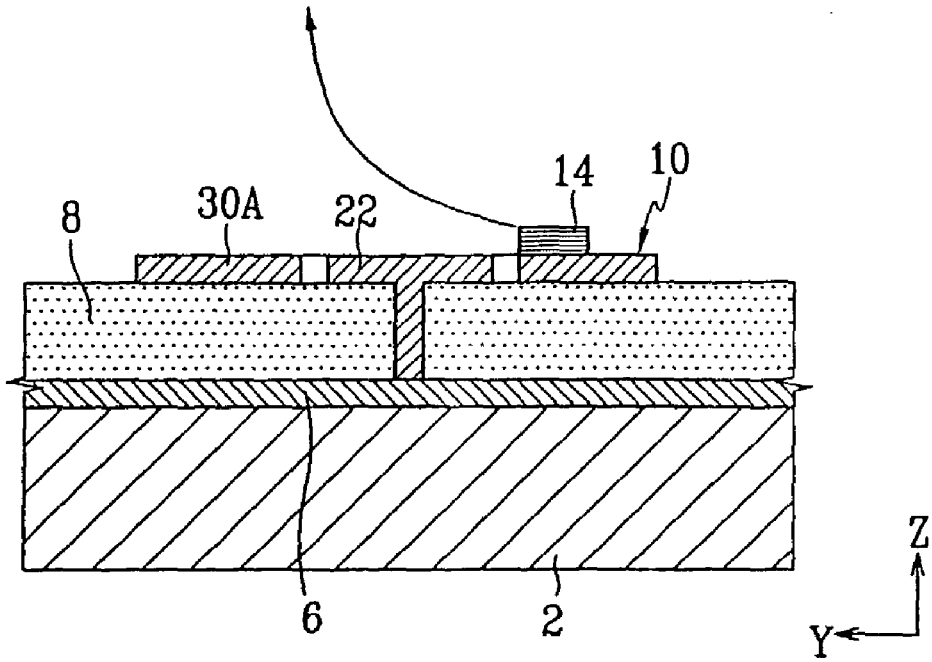
FIG. 19 is a partial sectional view taken along line I—I of FIG. 18
Figure 20:
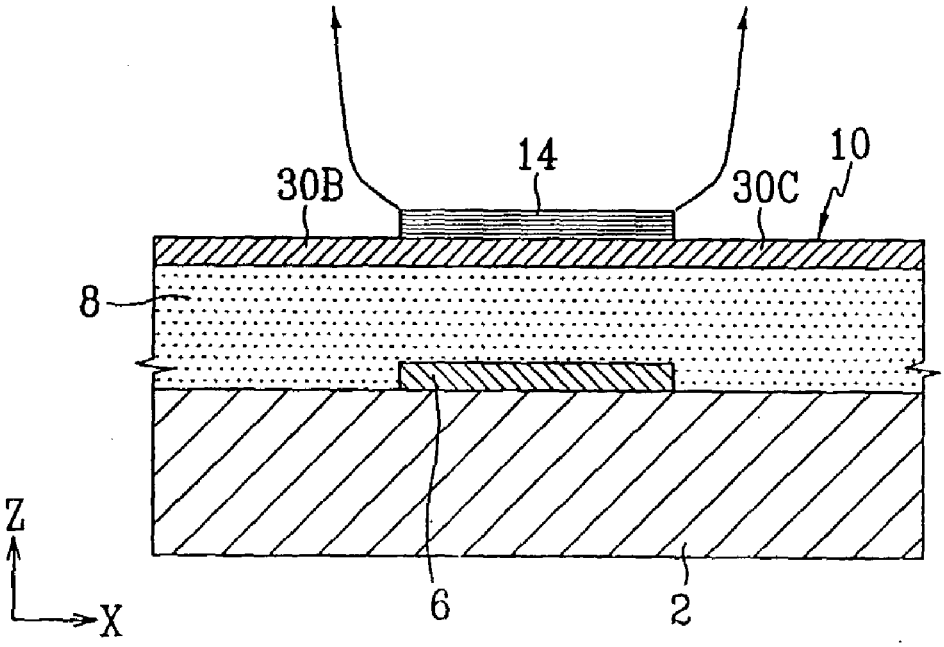
FIG. 20 is a partial sectional view taken along line II—II of FIG. 18.

FIG. 18 is a partial plan view of a rear substrate of FIG. 16, FIG. 19 is a partial sectional view taken along line I—I of FIG. 18, and FIG. 20 is a partial sectional view taken along line II—II of FIG. 18.

Referring first to FIG. 18, to describe the focusing function of cathode electrodes 10, areas of cathode electrodes 10 are designated as follows. An area of cathode electrodes 10 adjacent to the side of field enhancing sections 12 opposite the side where emitters 14 are provided is referred to as first region 30A, and areas of cathode electrodes 10 adjacent to the sides of field enhancing sections 12 that are formed along an axis Y direction are referred to as second region 30B and third region 30C.

Also, the case will be described in which a scan voltage of −100V is applied to lower cathode electrode 10 (in the drawing) and a data voltage of 70V is applied to center gate electrode 6 (in the drawing) to turn on a pixel formed by the intersection of this cathode electrodes 10 and gate electrode 6. In this case, 2 kV are applied to anode electrode 16, and 0V are applied to remaining cathode electrodes 10 and gate electrodes 6 to thereby turn the remaining pixels off.

With reference to FIG. 19, if this single pixel is turned on as described above, although most of the electron beams emitted from emitter 14 are attracted by the (+) voltage applied to anode electrode 16 to travel toward phosphor layer 18 of a corresponding pixel, some of the electron beams are attracted also by a (+) potential applied to counter electrode 22 to be diffused toward counter electrode 22. However, a (−) potential applied to first region 30A provides a repelling force to the electron beams diffused toward counter electrodes 22. This repelling force pushes these electron beams so that they are focused toward phosphor layer 18 of the corresponding pixel.

Further, with reference to FIG. 20, some of the electron beams emitted from emitters 14 may also diffuse in the axis X direction. However, the (−) potential applied to second and third regions 30B and 30C of cathode electrodes 10 provides a repelling force to these electron beams to focus the same toward phosphor layer 18 of the corresponding pixel.

In the above configuration, increases in a width of first region 30A allow improvements in the focusing of the electron beams, and for a conductivity of cathode electrodes 10, which is reduced by field enhancing sections 12, to be sufficiently maintained. Accordingly, it is preferable that field enhancing sections 12 be formed such that the sides adjacent to where emitters 14 are mounted are set closer to the corresponding long sides of cathode electrodes 10 than the other sides of field enhancing sections 12 are to the opposite long sides of cathode electrodes 10.

In accordance with the first through eighth embodiments of the present invention, as a first advantage, the deflection of emitted electrons between the emitters of each pixel is effectively limited to thereby minimize the neighboring effect. Therefore, same polarity driving is possible in which a (+) scan voltage is applied to the gate electrodes and a (+) data voltage is applied to the cathode electrodes. This is particularly true when the emitters are surrounded by the cathode electrodes as in the first, second, third, sixth, and eighth embodiments. It should be noted that the general drive method of applying a (−) scan voltage to the cathode electrodes and a (+) data voltage to the gate electrodes may also be used in accordance with the present invention.

In accordance with an FED having the structure of the third embodiment, while varying the voltage applied to the cathode electrodes and the gate electrodes, instances at which electrons are emitted from the emitters were determined. Such a determination was made by checking the illumination of the phosphor layers. The results of such determination are shown in Table 1 below. Using the line-sequential mode, 100V were applied to selected gate electrodes and 0V were applied to the gate electrodes that were not selected. Also, 0V were applied to the cathode electrodes when in an on state, and 50V when in an off state.

TABLE 1

| | | Cathode electrodes | |
|---|---|---|---|
| | | 0 V | 50 V |
| Gate electrodes | 100 V | Illumination | No illumination |
| | 0 V | No Illumination | No illumination |

From Table 1, it is clear that electrons are emitted from the emitters in pixels where there is the intersection of the gate electrodes to which 100V are applied and the cathode electrodes to which 0V are applied. The remaining three combinations of application voltages to the gate and cathode electrodes resulted in no emission of electrons. Grays in such a FED may be realized using conventional pulse width modulation methods.

Figure 21:
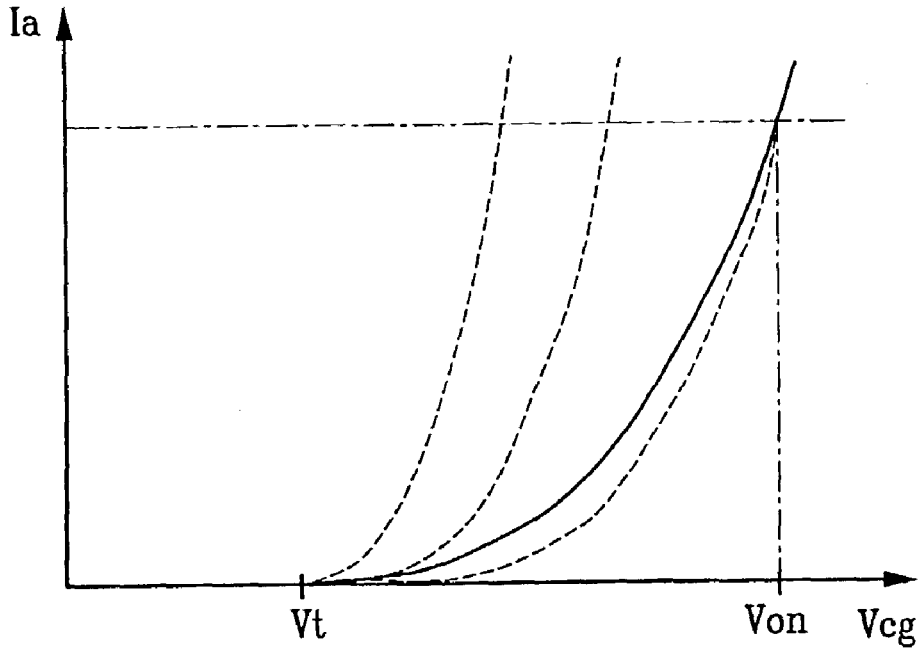
FIG. 21 is graph showing anode current (la) as a function of a cathode-gate voltage difference (Vcg).

FIG. 21 is graph showing anode current (Ia) as a function of a cathode-gate voltage difference (Vcg). Vt indicates a threshold voltage at which electron emission begins, and Von indicates a pixel display voltage that satisfies a current level required for pixel display. Also, the dotted lines in the graph indicate I-V curves for each pixel, and the solid line indicates the I-V curve occurring during actual operation.

In the conventional FED, the electric fields formed in the cathode electrodes are affected by the distance to adjacent cathode electrodes and the geometric configuration of the electrodes. Accordingly, if a large display device is manufactured, the difference in emission currents between pixels may become extremely large under the same voltage conditions as a result of manufacturing tolerance stackup. Accordingly, anode currents la, which are a function of the cathode-gate voltage Vcg, exhibit the differences shown in the graph.

Therefore, in order to minimize non-uniform display characteristics of each pixel, since threshold voltage Vt must be matched with pixels with high characteristics, and pixel display voltage Von must be matched with pixels with low characteristics, the drive voltage level must reflect the I-V curve of the solid line during simple matrix driving. In this case, Equation (1) below in the solid line I—V curve of one pixel is satisfied experimentally, while Equation (2) below is satisfied during actual driving in the solid line I-V curve.

$$Von=2Vt \quad (1)$$

$$Von>2Vt \quad (2)$$

In the above case, a (−) scan voltage is applied to the cathode electrodes, and a (+) data voltage is applied to the gate electrodes in the conventional FED while satisfying Equation (3) below.

$$Von=Vscan\ (scan\ voltage)+Vdata\ (data\ voltage) \quad (3)$$

In the three cases where one or more of the cathode electrodes or gate electrodes are controlled off, the electric fields in the peripheries of the emitters should not be formed, and electric field emission occurs when 1 or 2 are controlled off by the neighboring effect. This results in a reduction in contrast.

However, in accordance with embodiments of the FED of the present invention, the gate electrodes are used as scan electrodes, the cathode electrodes are used as data electrodes, and a positive voltage is applied to both of the cathode and data electrodes. Therefore, the deterioration in contrast—even in large display device that have non-uniform electric field characteristics—is prevented.

For example, in the case where pixel display voltage Von is 120V and threshold voltage Vt is 50V, if 120V are applied to the gate electrodes as a scan voltage (120V when selected and 0V when not selected) and 70V are applied to the cathode electrodes as a data voltage (0V in on conditions and 70V in off conditions), the off state may be precisely maintained in the three no illumination conditions of Table 1.

As a second advantage of the present invention, the electric field emission regions are enlarged such that the strength of the electric fields applied to the emitters is increased and the electron emission effect is improved. This is particularly true with the structures of the fourth and fifth embodiments.

Figure 22:
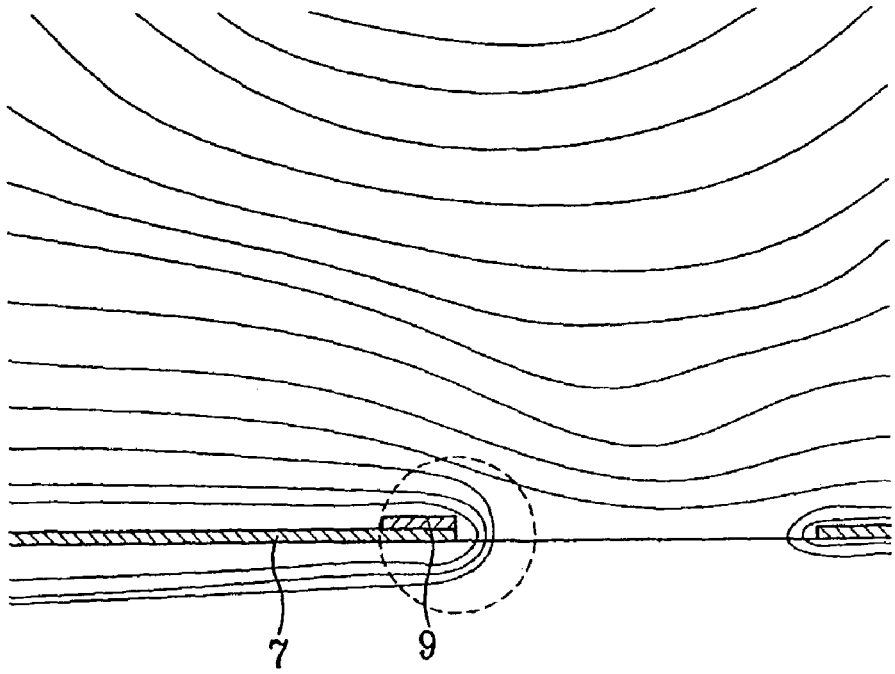
FIG. 22 (prior art)
FIG. 22 is a schematic view showing the distribution of equipotential lines formed around an emitter in a conventional field emission display.
Figure 23:
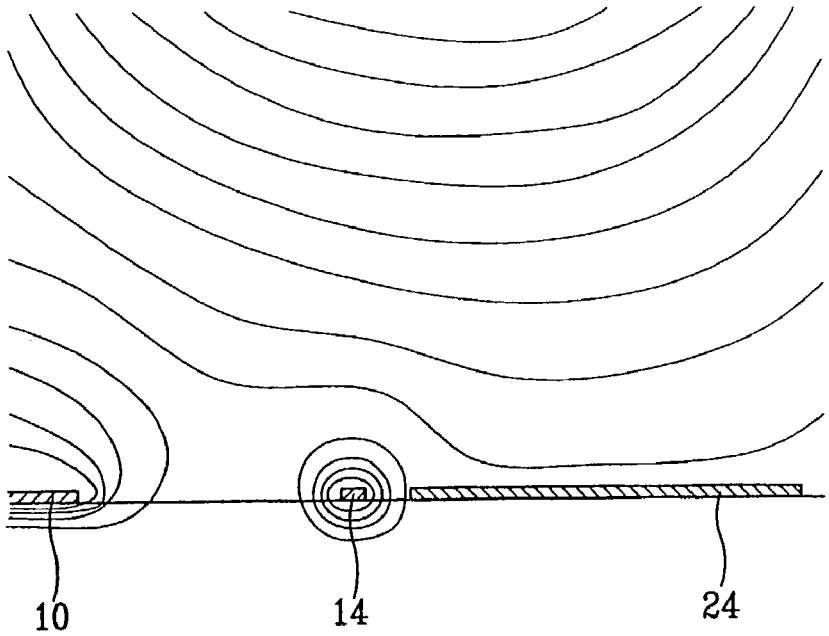
FIG. 23 is a schematic view showing the distribution of equipotential lines formed around an emitter in a field emission display according to the fourth embodiment of the present invention.
Figure 24:
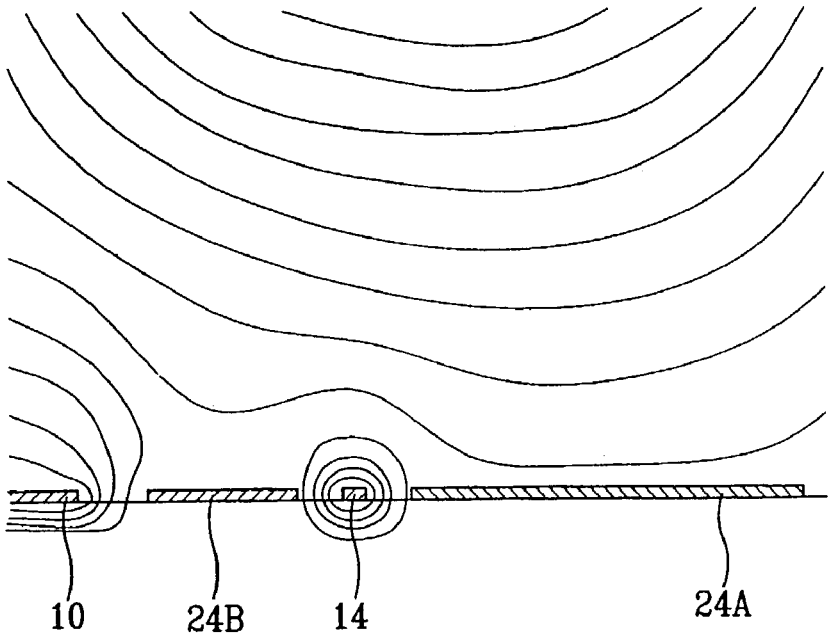
FIG. 24 is a schematic view showing the distribution of equipotential lines formed around an emitter in a field emission display according to the fifth embodiment of the present invention.
Figure 26:
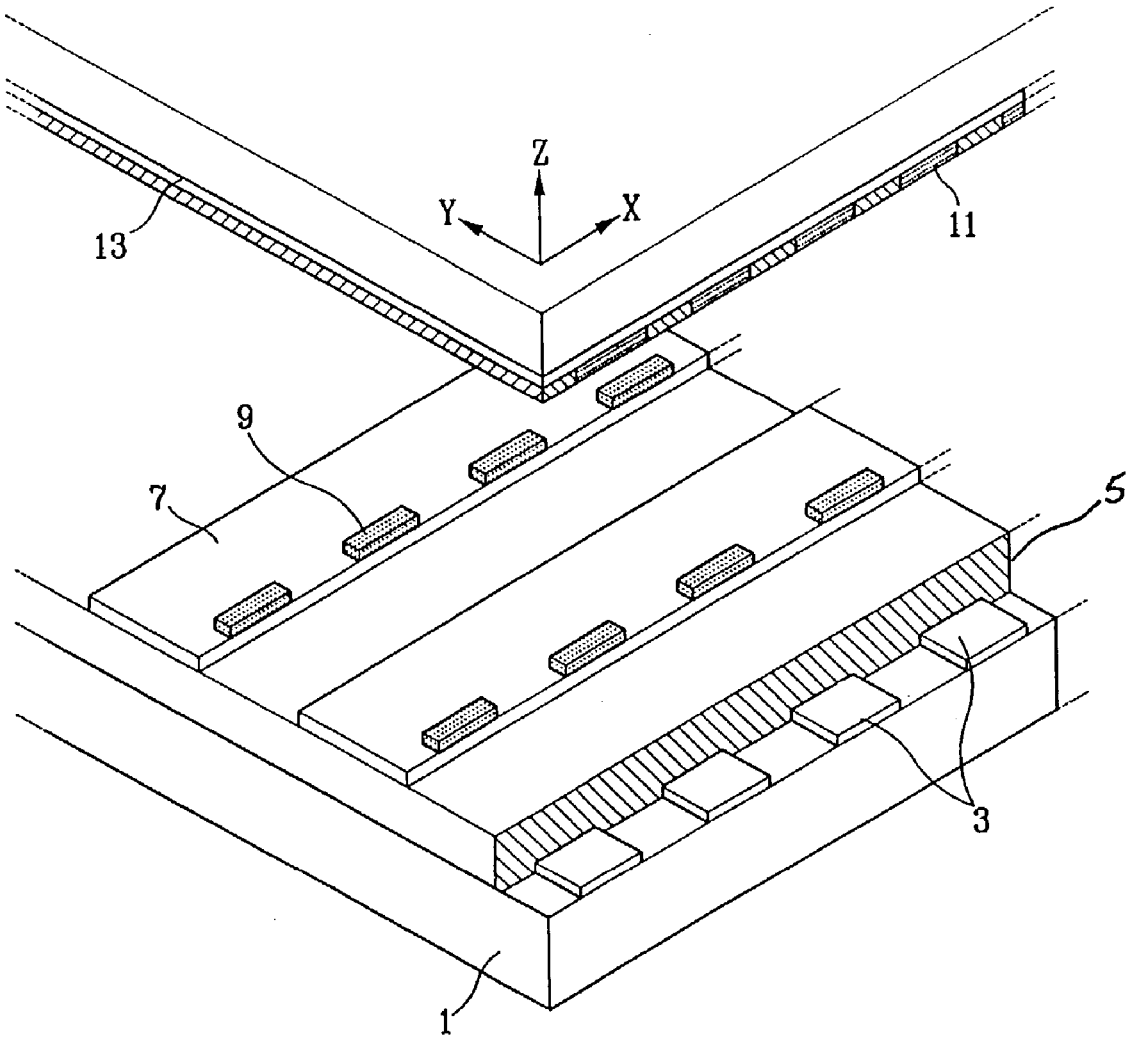
FIG. 26 (prior art)
FIG. 26 is a partial exploded perspective view of a conventional field emission display.

FIG. 22 is a schematic view showing the distribution of equipotential lines formed around an emitter in a conventional field emission display (comparative example) that does not include field enhancing sections and counter electrodes (see also FIG. 26). Further, FIGS. 23 and 24 are schematic views showing the distribution of equipotential lines formed around an emitter in the field emission display according to the fourth embodiment and fifth embodiment, respectively, of the present invention. The drive conditions used for the experiment are as shown in Table 2 below. To better illustrate the equipotential lines, the cathode electrodes under the emitters are not shown in FIGS. 23 and 24.

TABLE 2

| | |
|---|---|
| Cathode electrode voltage | −100 V |
| Gate electrode voltage | 60 V |
| Anode electrode voltage | 600 V |

With respect to the comparative example shown in FIG. 22, the equipotential lines surround all of cathode electrode 7. Further, since the width of cathode electrode 7 is substantial, an area where the equipotential lines that induce electron discharge is dense, that is, a field emission region (indicated by the circle in the drawing) is distributed while being limited to a corner of cathode electrode 7 (i.e., a periphery of emitter 9).

However, with the configuration of the fourth embodiment shown in FIG. 23 and that of the fifth embodiment shown in FIG. 24, the equipotential lines are more densely distributed around emitter 14. Further, in the structure of the fifth embodiment, auxiliary counter electrode 24B provides a pushing force to the equipotential lines in the direction of cathode electrode 10 to thereby realize even more effective electron emission.

Figure 25:
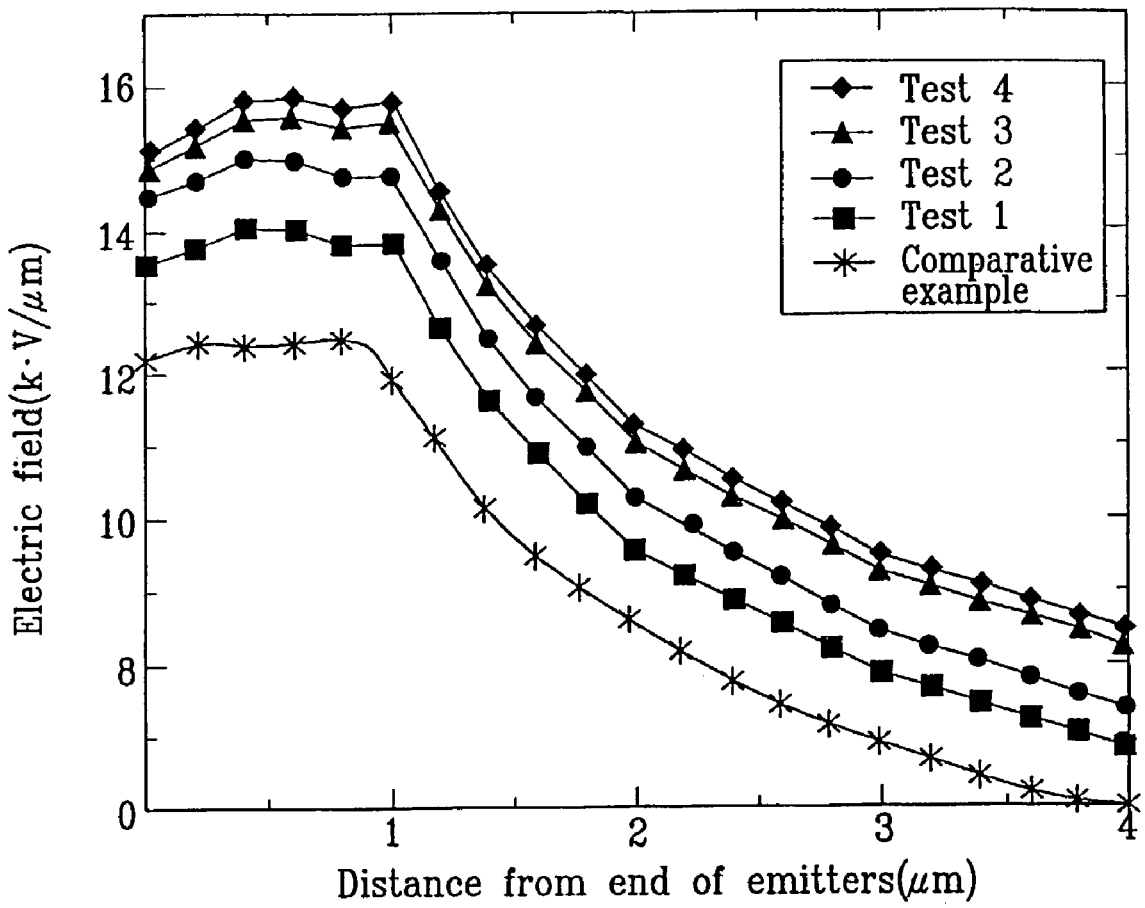
FIG. 25 is a graph showing electric field intensities as a function of distance from ends of emitters for various field emission displays including conventional field emission displays and field emission displays according to the fourth and fifth embodiments of the present invention.

FIG. 25 is a graph showing electric field intensities as a function of distance from ends of emitters for various field emission displays including a conventional field emission display and field emission displays according to the fourth and fifth embodiments of the present invention. In the graph, the horizontal axis represents a location of electric field measurement. Electric field was measured while varying a distance from the emitters to within the cathode electrodes in a range of up to 0.2 μm.

In the graph, Test 1 and Test 3 are when the distance D3 of the fourth embodiment is set at 50 μm and 20 μm, respectively. Also, Test 2 and Test 4 are when the distance D3 of the fifth embodiment is set at 50 μm and 20 μm, respectively. The width of the cathode electrodes in the comparative example and the embodiments is 250 μm.

As shown in the graph, in the case of Tests 1 through 4, the intensity of the electric fields is greater over all measurement locations over the comparative example. If Tests 1 through 4 are compared among themselves, a stronger electric field is formed around the emitter with decreases in the distance D3 of the cathode electrode. Further, when the distance D3 is identical, the structure of the fifth embodiment in which the auxiliary counter electrodes are formed in the field enhancing sections results in a stronger electric field than the structure of the fourth embodiment that does not include the auxiliary counter electrodes.

In Table 3 below, the results of the above experiment are expressed numerically. In the table, a length of electric field emission indicates a length of an electric field region in excess of an off field. It may be assumed that the length of electric field emission region is proportional to the width of the electric field emission region. Further, average electric field is a value obtained by dividing electric field strength by the length of the electric field emission region, and k in the units of this value is a proportionality constant.

TABLE 3

| | Length of electric field emission region (μm) | Average electric field (k · V/m) | Electric field current (A) |
|---|---|---|---|
| Comparative example | 1.6 | 11.843 | 127.17 |
| Test 1 | 2.2 (137.5%) | 12.260 (103.5%) | 184.14 (144.8%) |
| Test 2 | 2.4 (150.0%) | 12.857 (108.6%) | 220.35 (173.3%) |
| Test 3 | 3.0 (187.5%) | 12.791 (108.0%) | 270.55 (212.7%) |
| Test 4 | 3.2 (200.0%) | 12.812 (108.2%) | 289.26 (227.5%) |

(In Table 3 above, the numerical values in parentheses indicate percentage based on the values of the comparative example.)

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A field emission display, comprising:

a first substrate and a second substrate opposing one another with a predetermined gap therebetween;

at least one gate electrode formed on the first substrate;

an insulation layer formed over a surface of the first substrate covering the at least one gate electrode;

cathode electrodes formed over the insulation layer and having field enhancing sections that expose the insulation layer corresponding to pixel regions;

electron emission sources formed on the cathode electrodes adjacent at least one side of the field enhancing sections; and an illumination assembly formed on a surface of the second substrate opposing the first substrate, the illumination assembly realizing a display of images by electrons emitted from the electron emission sources.

2. The field emission display of claim 1, wherein the electron emission sources are made of a carbon-based material selected from the group consisting of carbon nanotubes, graphite, diamond, diamond-like carbon, C60 (Fullerene), and a mixture of these carbon-based materials.

3. The field emission display of claim 1, wherein the field enhancing sections are quadrilateral, and the electron emission sources are formed adjacent to at least one side of the field enhancing sections parallel to respective gate electrodes.

4. The field emission display of claim 1, wherein each of the field enhancing sections formed in the cathode electrodes and that expose the insulation layer corresponding to each of the pixel regions includes a main field enhancing section and an auxiliary field enhancing section that are formed along the cathode electrodes.

5. The field emission display of claim 4, wherein the main field enhancing sections and the auxiliary field enhancing sections are quadrilateral, and the electron emission sources are formed adjacent to a side of the main field enhancing sections that are closest to the auxiliary field enhancing sections.

6. The field emission display of claim 4, wherein a distance between each of the auxiliary field enhancing sections and the main field enhancing section corresponding to an adjacent pixel is greater than a distance between each of the auxiliary field enhancing sections and the main field enhancing section corresponding to the same pixel.

7. The field emission display of claim 4, further comprising counter electrodes positioned in the main field enhancing sections and connected to respective gate electrodes.

8. The field emission display of claim 1, further comprising counter electrodes positioned in the field enhancing sections and connected to respective gate electrodes.

9. The field emission display of claim 8, wherein the counter electrodes are connected to the respective gate electrodes by contacting the respective gate electrodes through via holes formed in the insulation layer.

10. The field emission display of claim 8, wherein the counter electrodes maintain a predetermined distance from the cathode electrodes within the field enhancing sections.

11. The field emission display of claim 1, wherein the electron emission sources are formed on an upper surface and extending over a side surface of the cathode electrodes.

12. The field emission display of claim 1, wherein the electron emission sources are formed on the insulation layer, and the cathode electrodes are formed on the electron emission sources covering a portion of the electron emission sources.

13. The field emission display of claim 1, further comprising counter electrodes positioned between the cathode electrodes and connected to respective gate electrodes.

14. The field emission display of claim 13, wherein the electron emission sources are formed on the cathode electrodes between the field enhancing sections and the counter electrodes.

15. The field emission display of claim 14, wherein a distance between a long edge of the cathode electrodes on which the emitters are mounted and the field enhancing sections is less than a distance between an opposite long edge of the cathode electrodes where the emitters are not located and the field enhancing sections.

16. The field emission display of claim 14, further comprising auxiliary counter electrodes positioned in the field enhancing sections and connected to the respective gate electrodes.

17. The field emission display of claim 14, further comprising pushing electrodes formed between the counter electrodes and the cathode electrodes in a direction of a long axis of the cathode electrodes.

18. The field emission display of claim 17, wherein the pushing electrodes receive an application of 0V or a negative voltage to provide a repelling force to electron beams emitted from the electron emission sources.

19. The field emission display of claim 1, wherein the field enhancing sections are quadrilateral, the electron emission sources are formed adjacent to a side of the field enhancing sections parallel to a long axis direction of the gate electrodes, and the electron emission sources are positioned at a predetermined distance from a long edge of the cathode electrodes.

20. The field emission display of claim 19, wherein a side of the field enhancing sections adjacent to which the electron emission sources are positioned is formed closer to the long edge of the cathode electrodes than an opposite side of the field enhancing sections.

21. The field emission display of claim 19, further comprising counter electrodes positioned in the field enhancing sections and connected to respective gate electrodes.

22. The field emission display of claim 1, wherein the illumination assembly includes an anode electrode to which a high voltage required to accelerate electron is applied, and red (R), green (G), and blue (B) phosphor layers that are excited when electrons land on the red (R), green (G), and blue (B) phosphor layers to emit visible light.

23. A field emission display, comprising:

a first substrate and a second substrate opposing one another with a predetermined gap therebetween;

at least one gate electrode formed on the first substrate;

an insulation layer formed over a surface of the first substrate covering the at least one gate electrode;

cathode electrodes formed over the insulation layer and having field enhancing sections,that expose the insulation layer corresponding to pixel regions;

electron emission sources formed on the cathode electrodes adjacent at least one side of the field enhancing sections parallel to respective gate electrodes; and an illumination assembly formed on a surface of the second substrate opposing the first substrate, the illumination assembly realizing the display of images by electrons emitted from the electron emission sources.

24. The field emission display of claim 23, further comprising counter electrodes positioned in the field enhancing sections and connected to the respective gate electrodes.

25. The field emission display of claim 23, further comprising auxiliary field enhancing sections positioned at a predetermined distance from the electron emission sources and formed exposing the insulation layer.

26. A field emission display, comprising:

a first substrate and a second substrate opposing one another with a predetermined gap therebetween;

at least one gate electrode formed on the first substrate;

an insulation layer formed over a surface of the first substrate covering the at least one gate electrode;

cathode electrodes formed over the insulation layer and having field enhancing sections that expose the insulation layer corresponding to pixel regions;

electron emission sources formed on the cathode electrodes adjacent at least one side of the field enhancing sections parallel to the cathode electrodes; and an illumination assembly formed on a surface of the second substrate opposing the first substrate, the illumination assembly realizing a display of images by electrons emitted from the electron emission sources.

27. The field emission display of claim 26, further comprising counter electrodes positioned between the cathode electrodes and connected to respective gate electrodes.

28. The field emission display of claim 27, wherein the electron emission sources are positioned on the cathode electrodes between the field enhancing sections and counter electrodes.

29. The field emission display of claim 28, further comprising auxiliary counter electrodes positioned in the field enhancing sections and connected to the respective gate electrodes.

30. The field emission display of claim 27, further comprising pushing electrodes formed between the counter electrodes and the cathode electrodes in a direction of a long axis of the cathode electrodes.

31. The field emission display of claim 26, wherein the electron emission sources are positioned at a predetermined distance from a long edge of the cathode electrodes, and are surrounded by the cathode electrodes on all sides except a side closest to the field enhancing sections.

* * * * *